US005741617A

United States Patent [19]

Inaba et al.

[11] Patent Number: 5,741,617

[45] Date of Patent: Apr. 21, 1998

[54] TONER FOR DEVELOPING ELECTROSTATIC IMAGES

[75] Inventors: Koji Inaba, Yokohama; Tatsuya Nakamura, Tokyo; Tatsuhiko Chiba, Kamakura; Takao Ishiyama, Kawasaki, all of Japan

[73] Assignee: Canon Kabushiki Kaisha, Tokyo, Japan

[21] Appl. No.: 457,779

[22] Filed: Jun. 1, 1995

[30] Foreign Application Priority Data

Jun. 2, 1994 [JP] Japan ..... 6-142228

[51] Int. Cl.[6] ..... G03G 9/08

[52] U.S. Cl. ..... 430/110; 430/904

[58] Field of Search ..... 430/110, 904

[56] References Cited

U.S. PATENT DOCUMENTS

| | | | |
|---|---|---|---|
| 2,297,691 | 10/1942 | Carlson . | |
| 4,465,756 | 8/1984 | Mikami et al. | 430/110 |
| 4,578,338 | 3/1986 | Gruber et al. | 430/120 |
| 4,774,395 | 9/1988 | Yabuuchi et al. | 219/275 |
| 4,810,612 | 3/1989 | Ueda et al. | 430/109 |
| 4,898,802 | 2/1990 | Hsieh et al. | 430/110 |
| 4,917,982 | 4/1990 | Tomono et al. | 430/99 |
| 4,988,598 | 1/1991 | Tomono et al. | 430/99 |
| 4,990,424 | 2/1991 | Van Dusen et al. | 430/106.6 |
| 5,124,225 | 6/1992 | Shibata | 430/110 |
| 5,143,812 | 9/1992 | Mori et al. | 430/124 |
| 5,384,224 | 1/1995 | Tanikawa et al. | 430/110 |
| 5,466,555 | 11/1995 | Taguchi et al. | 430/110 |

FOREIGN PATENT DOCUMENTS

| | | |
|---|---|---|
| 0574853 | 12/1993 | European Pat. Off. . |
| 0578093 | 1/1994 | European Pat. Off. . |
| 0587540 | 3/1994 | European Pat. Off. . |
| 42-23910 | 11/1967 | Japan . |
| 43-24748 | 10/1968 | Japan . |
| 52-3304 | 1/1977 | Japan . |
| 52-3305 | 1/1977 | Japan . |
| 56-13915 | 4/1981 | Japan . |
| 57-52574 | 3/1982 | Japan . |
| 59-53856 | 3/1984 | Japan . |
| 59-61842 | 4/1984 | Japan . |
| 60-217366 | 10/1985 | Japan . |
| 60-252360 | 12/1985 | Japan . |
| 60-252361 | 12/1985 | Japan . |
| 61-94062 | 5/1986 | Japan . |
| 61-138259 | 6/1986 | Japan . |
| 61-273554 | 12/1986 | Japan . |
| 62-14166 | 1/1987 | Japan . |
| 1-109359 | 4/1989 | Japan . |
| 1-185660 | 7/1989 | Japan . |
| 1-185661 | 7/1989 | Japan . |
| 1-185662 | 7/1989 | Japan . |
| 1-185663 | 7/1989 | Japan . |
| 1-238672 | 9/1989 | Japan . |
| 2-79860 | 3/1990 | Japan . |
| 3-50559 | 3/1991 | Japan . |
| 4-107467 | 4/1992 | Japan . |
| 4-149559 | 5/1992 | Japan . |

OTHER PUBLICATIONS

Patent Abstracts, Japan, vol. 14, No. 61 (P1001) [4004] 1990.

Diamond, Arthur S., Handbook of Imaging Materials. New York: Marecl–Dekker, Inc., pp. 162–170, 193–196, 1991.

Grant, Roger & Claire Grant, Grant & Hackh's Chemical Dictionary. New York: Marcel–Dekker, Inc. p. 116, 1987.

*Primary Examiner*—Christopher D. Rodee

*Attorney, Agent, or Firm*—Fitzpatrick, Cella, Harper & Scinto

[57] ABSTRACT

A toner for developing electrostatic images, which comprises a binder resin, a colorant and a wax composition, characterized in that the wax composition has a molecular weight distribution as measured by GPC, having a maximum in the region of molecular weight of from 350 to 850 and a maximum in the region of molecular weight of from 900 to 4,000; and the wax composition contains an ester wax with a weight average molecular weight (Mw) of from 350 to 4,000 and a number average molecular weight of from 200 to 4,000.

28 Claims, 4 Drawing Sheets

TONER FOR DEVELOPING ELECTROSTATIC IMAGES

BACKGROUND OF THE INVENTION

1. Field of the invention

The present invention relates to a toner for developing electrostatic images which cycels in fixing the toner images formed by electrophotography, electrostatic recording etc. to a transfer medium by the heat and pressure fixing method, and an image forming method carried out using such a toner.

2. Related Background Art

A number of methods of electrophotography have been known, as disclosed in U.S. Pat. No. 2,297,691, Japanese Patent Publications No. 42-23910 and No. 43-24748 and so forth, where, in general, copies or prints are obtained by forming an electrostatic latent image on a photosensitive member utilizing a photoconductive material by various means, subsequently developing the latent image with a toner, and transferring the toner image to a transfer medium such as paper by direct or indirect means according to necessity, followed by fixation by the action of heat, pressure, heat-and-pressure, or solvent vapor. The toner not transferred to, and remaining on the photosensitive member is cleaned by various means, and then the above process can be repeated.

A usual method to form a full-color image is as follows: A photosensitive member is electrostatically charged uniformly by means of a primary charger, and imagewise exposure is carried out using laser light modulated by magenta image signals from the original, to form an electrostatic image on the photosensitive member. The electrostatic image is developed by a magenta toner held in a magenta developing assembly, to form a magenta toner image. Next, onto a movable transfer medium, the magenta toner image formed on the photosensitive member is transferred by means of a transfer charger, directly or via an intermediate transfer member.

After that, the photosensitive member is destaticized by means of a residual charge eliminator, and cleaned by a cleaning means. Thereafter, it is again electrostatically charged by the primary charger, and a cyan toner image is similarly formed. The cyan toner image is transferred to the transfer medium on which the magenta toner image has been transferred, and then a yellow toner image and a black toner image are successively formed and developed so that the four color toner images are superposed on the transfer medium. The four color toner images are fixed to the transfer medium by the fixing means through the action of heat and pressure. Thus, a full-color image is formed.

In recent years, such image forming apparatus are not only used as copying machines to make copies of originals in the office, but also are used as printers for computer output and personal copying machines.

In addition to such a field as typified by laser beam printers, such apparatus are also being applied in plain-paper facsimile machines.

Under such circumstances, it is strongly required for the apparatus to be of small size and light weight, high speed performance, high image quality and high reliability. Moreover, such machines have now been composed of simpler components in various points. As a result, much higher performance is now required for toners, and excellent image formation can no longer be accomplished without the improvement of the toner performance. In recent years, with divergent needs for copying, demand for color copying has been rapidly increasing. In order to achieve more faithful copying of original color images, much higher image quality and much higher resolution are required. From such a viewpoint, the toners used in the color image forming method should have good melt properties and color-mixing properties when heat is applied, as well as a low melting point, sharp-melt properties and low melt viscosity.

Use of the toners having sharp-melt properties can broaden the range of color reproduction of copied matter to obtain color copies faithful to original images.

A toner having high sharp-melt properties, however, also shows high affinity for the fixing roller so that it tends to migrate to the fixing roller during fixing.

In particular, in the case of a fixing assembly of a full-color image forming apparatus, offset phenomenon tends to occur because the toner layer thickness increase, that is, layers of magenta, cyan, yellow, and black toners are present on the transfer medium.

In order to prevent toner adhesion to the surface of the fixing roller, hitherto the roller surface is formed from a material such as silicon rubber or a fluorine resin, having an excellent releasability to the toner. In addition, the surface is further covered with a thin film of a fluid having high releasability as exemplified by silicone oil or fluorine oil to prevent the offset phenomenon and fatigue of the surface. This method, though effective in preventing offset of toner, requires a device for feeding the anti-offset fluid, thus complicating the fixing assembly. Oil application is also a problem in that it causes separation of layers constituting the fixing roller and consequently shortens the lifetime of the fixing roller.

As transfer mediums on which toner images are fixed, various kinds of paper, coated paper, plastic films and so forth are commonly used. In particular, a need for transparent films (OHP films) has been increasing, which are used for presentation using an overhead projector. Different from paper, a large quantity of oil remains on the OHP film surface after fixing, because of the low oil absorption capacity of the film. Silicone oil may evaporate with heating to contaminate the interior of image forming apparatus, and also there is a problem of disposal of recovered oil. Based on the idea that the fluid for preventing offset should be fed from the inside of toner particles at the time of heat and pressure fixing without use of any device for feeding silicone oil, a method has been proposed in which a release agent such as a low-molecular weight polyethylene or a low-molecular weight polypropylene is added to toner particles. Addition of such a release agent in a large quantity in order to attain a satisfactory effect tends to cause filming of the photosensitive member or contamination of the surfaces of carriers and a toner carrying member such as a developing sleeve, leading to image deterioration. At present, the release agent is added to toner particles in an amount small enough not to cause image deterioration, where a small amount of releasing oil is fed and the toner that may cause offset is removed by means of a device employing a member such as a web of a wind-up type or by means of a cleaning pad.

However, taking account of the recent demand for small size, light weight and high reliability, it is preferable to omit even such supplementary devices.

In the field of full-color images, a high crystallization of the release agent contained in toner particles or a difference in refractive index between the release agent and the binder resin tends to cause a problem such as decrease of the image transparency or deterioration of haze of the OHP film images after fixing.

Japanese Patent Publications No. 52-3304 and No. 3305 and Japanese Patent Application Publication No. 57-52574 disclose the incorporation of a wax into toner particles as the release agent.

Japanese Patent Applications Laid-open No. 3-50559, No. 2-79860, NO. 1-109359, No. 62-14166, No. 61-273554, No. 61-94062, No. 61-138259, No. 60-252361, No. 60-252360 and No. 60-217366 disclose incorporation of waxes in toners.

Waxes are used for the purpose of improving anti-offset properties at low- and high-temperature fixing of toners or improving fixing performance at low-temperature fixing. On the other hand, by using a wax, the blocking resistance of toners may decrease, the developing performance may be lowered because of the temperature rise in copying machines, the developing performance may deteriorate because of migration of wax toward toner particle surfaces when toners are left to stand for a long time.

Conventional toners have a tendency that which excel in anti-offset properties and developing performance are inferior in low-temperature fixing performance, or those which excel in low-temperature anti-offset properties or low temperature fixability are rather poor in blocking resistance and cause the deterioration of developing performance because of the temperature rise in the machine. Also, some of them cannot maintain anti-offset properties at both the high- and low-temperature fixing, or cannot provide OHP film images of high transparency.

Especially with regard to the transparency of OHP film images, it is proposed in Japanese Patent Applications Laid-open No. 4-149559 and No. 4-107467 to add to the wax a crystallization nucleating agent in order to control the crystallization of the wax itself. It is also proposed to add to a binder a substance with a good compatibility with the binder and a lower melt viscosity than the binder so that the surface of the toner layer becomes smooth after fixing.

As one of the release agents having a relatively good transparency and also a low-temperature fixing performance, there is a montan type wax. Japanese Patent Applications Laid-open No. 1-185660, No. 1-185661, No. 1-185662, No. 1-185663 and No. 1-238672 disclose the use of a montan type wax with a molecular weight of about 800, represented by the formula:

$$R_1-\overset{\overset{\displaystyle O}{\|}}{C}-O-(CH_2-CH_2)_n-O-\overset{\overset{\displaystyle O}{\|}}{C}-R_2$$

wherein $R_1$ and $R_2$ each represent a hydrocarbon group having 28 to 32 carbon atoms, and n represents an integer.

There, however, is room for improvement in view of transparency or haze (cloudiness) of OHP film images.

SUMMARY OF THE INVENTION

An object of the present invention is to provide a toner for developing electrostatic images that has solved the problems as discussed above.

Another object of the present invention is to provide a toner for developing electrostatic images that has superior low-temperature fixing performance and anti-offset properties.

Still another object of the present invention is to provide a toner for developing electrostatic images, that can be excellently fixed on a transfer medium with heat and pressure, requiring no or a little application of oil.

A further object of the present invention is to provide a toner for developing electrostatic images, that can form an OHP film image of high-quality and full-color with superior transparency.

The present invention provides a toner for developing electrostatic images, comprising a binder resin, a colorant and a wax composition;

said wax composition having a molecular weight distribution measured by GPC having one maximal value in a region of molecular weight of from 350 to 850 and another maximal value in a region of molecular weight of from 900 to 4,000; and said wax composition containing an ester wax with a weight average molecular weight (Mw) of from 350 to 4,000 and a number average molecular weight of from 200 to 4,000.

DESCRIPTION OF THE PREFERRED EMBODIMENTS

Figure 1:
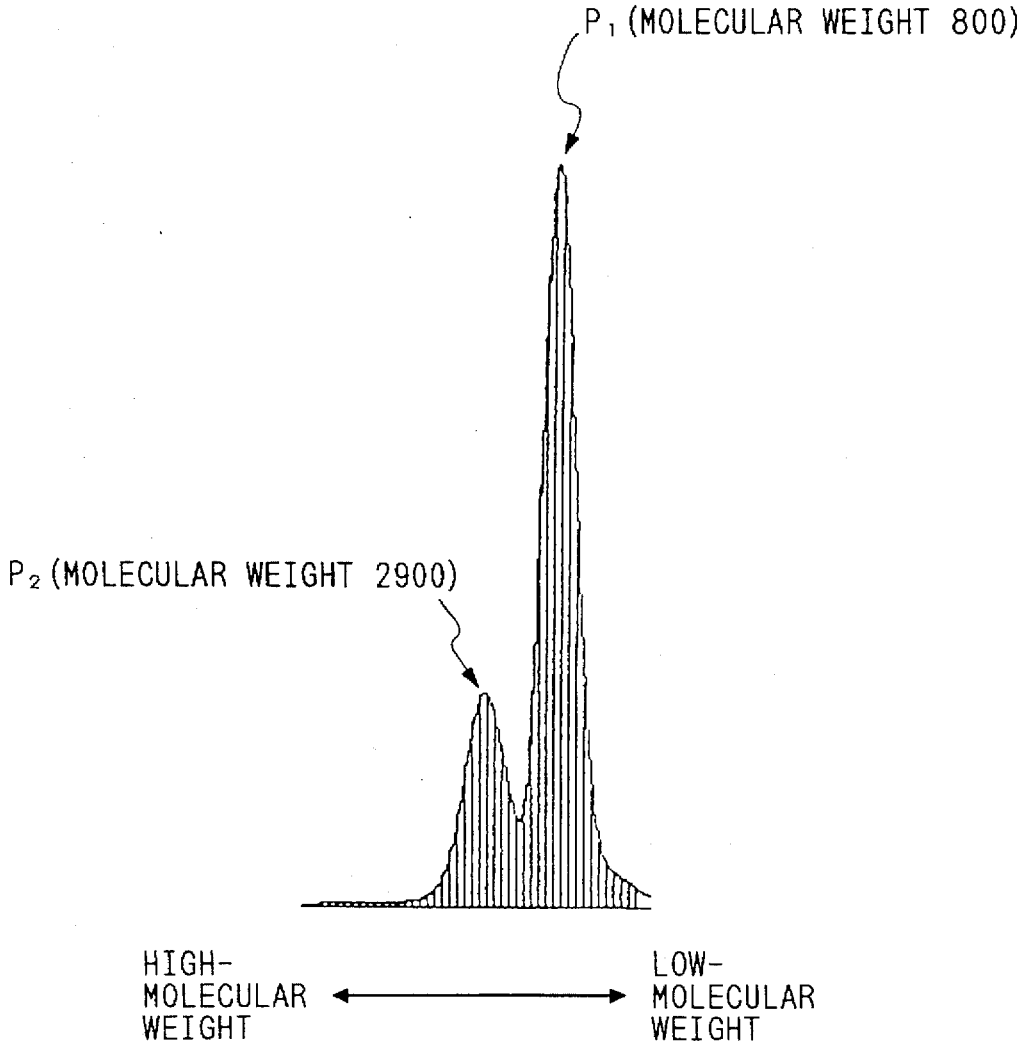
FIG. 1 shows a GPC chromatogram of Wax Composition No. 1.

In the present invention, in order to improve low-temperature fixing performance and anti-offset properties of toners and to attain a good transparency of color images on OHP films, the toner particles contain inside the particle a wax composition containing ester wax with a weight average molecular weight (Mw) of from 350 to 4,000 and a number average molecular weight of from 200 to 4,000, wherein said wax composition has a molecular weight distribution measured by GPC (gel permeation chromatography) having one maximal value in the region of molecular weight of from 350 to 850 and another maximal value in the region of molecular weight of from 900 to 4,000.

The average molecular weight and molecular weight distribution of the ester wax, the wax composition and other waxes are measured by GPC under the following conditions.

GPC Measurement Conditions

Apparatus: GPC-150C (Waters Co.)

Column: dual 30 cm columns of GMH-HT, (available from Tosoh Co., Ltd.)

Temperature: 135° C.

Solvent: o-Dichlorobenzene (0.1% ionol-added)

Flow rate: 1.0 ml/min

Sample: 0.4 ml of 0.15% sample is injected.

Molecular weights in the range of from about 200 to about 50,000 are measured under above conditions. Molecular weight of the sample is calculated using a molecular weight calibration curve prepared with monodisperse polystyrene standards, and further converted to a polyethylene basis according to a conversion expression derived from the Mark-Houwink viscosity equation.

The wax composition used in the present invention preferably should have an appropriate affinity for the binder resin, high hydrophobicity, a low melting point and low crystallizability to exhibit good low-temperature fixing performance.

The wax composition can be prepared by blending a low-molecular weight wax and a high-molecular weight wax, so that at least two peaks are present in the molecular weight distribution of the wax composition, whereby the crystallizability can be controlled and the transparency can be improved.

The waxes may be blended by various methods, for example, the waxes are melt-blended using a media-type dispersion machine (e.g. a ball mill, a sand mill, an attritor, an apex mill, a coball mill or a handy mill) at a temperature not lower than the melting points of the waxes, the waxes are blended by dissolving them in a solvent followed by solvent removal, or the waxes are dissolved in a polymerizable monomer and then blended by means of a media-type dispersion machine. In this blending, a pigment, a charge control agent and so forth may be added.

The low-molecular weight wax may preferably have a weight average molecular weight of from 350 to 850, and more preferably from 400 to 800. The high-molecular weight wax may preferably have a weight average molecular weight of from 900 to 4,000, and more preferably from 950 to 3,000. This is preferable to improve the low-temperature fixing performance and anti-offset properties of the toner.

The wax composition may more preferably have a molecular weight distribution measured by GPC having one maximal value in the region of molecular weight of from 400 to 800 and another maximal value in the region of molecular weight of from 950 to 3,000. A GPC chromatogram of a wax composition having maximal values at the molecular weights of about 800 and 2,900 is shown in FIG. 1 as an example.

The ester wax constituting the wax composition may preferably have a melting point at 30°–120° C., and more preferably from 50° to 100° C. Here the melting point means the temperature of the main maximal value in an endothermic curve measured according to ASTM D3418-8. If the melting point is lower than 30° C., lowering of performance tends to occur in prevention of toner blocking and in prevention of the contamination of the sleeve and the photosensitive member during many-sheet copying. If the melting point is higher than 120° C., excessive energy is required to uniformly mix the wax and the binder resin when the toner is produced by pulverization, and it is necessary to use a solvent of high boiling point or to use a pressure-resistant reaction vessel under high pressure when the toner is produced by polymerization, undesirably resulting in a very complicated apparatus.

The measurement according to ASTM D3418-8 is carried out using, for example, DSC-7, manufactured by Parkin Elmer Co. Temperature at the detection zone of the apparatus is calibrated using the melting points of indium and zinc, and the calories are calibrated using the heat of fusion of indium. A sample is placed on an aluminum pan, and an empty pan is set for a control, and measurement is carried out with temperature rise at 10° C./min.

Solubility parameter (SP), can be calculated using the Fedor's method (Polymer Engineering Science, 14(2), 147, 1974), which utilizes the additive properties of atomic groups.

The SP value of the ester wax used in the present invention may preferably be in the range of from 7.5 to 10.5. An ester wax having SP value less than 7.5 may have a poor compatibility with the binder resin, consequently making difficult the uniform dispersion of the ester wax in the resin, which may result in the adhesion of the ester wax to the developing sleeve and changes of charge quantity of the toner, as well as ground fog, and image density variation at toner supplement. Use of an ester wax having SP value more than 10.5 tends to cause blocking between toner particles during the long-term storage of the toner. Moreover, such a wax may have excess compatibility with the binder resin so that a sufficient release layer between a fixing member and a toner binder resin layer cannot be formed at the time of fixing, leading to offset phenomenon.

The melt viscosity of the ester wax used in the present invention may be measured at 130° C. by VP-500 of HAAKE CO. using a cone plate type rotor (PK-1). The ester wax may preferably have a melt viscosity of 1 to 300 cps, and more preferably 3 to 50 cps at 130° C. ester wax having a melt viscosity lower than 1 cps tends to cause sleeve contamination, because of the mechanical shear force generated when a thin toner layer is formed on the sleeve by using a blade or the like in a non-magnetic one component development system. Also in a two-component development system, the toner tends to become damaged because of the shear force acting between the toner and the carrier, tending to cause bury-in of external additives and crushing of toner particles. If the ester wax has a melt viscosity higher than 300 cps, the viscosity of a polymerizable monomer mixture formed in the toner production by polymerization may become too high to readily obtain a fine-particle toner having a uniform particle diameter, tending to result in a toner with a broad particle size distribution.

Hardness of the ester wax can be measured by using, for example, Shimadzu Dynamic Ultrafine Hardness Meter (DUH-200). For measurement, a Vickers penetrator is moved by 10 μm under a load of 0.5 g at a loading rate of 9.67 mm/sec, and then kept for 15 seconds, and a depression made on the sample is analyzed to determine Vickers hardness. The sample is previously melted and molded into a 5 mm thick cylinder, using a mold of 20 mm diameter. The ester wax may preferably have a hardness ranging from 0.3 to 5.0. It is especially preferable for the wax to have a Vickers hardness of from 0.5 to 3.0.

A toner containing an ester wax having a Vickers hardness lower than 0.3 tends to crush at the cleaning zone of the copying machine and adhere to the drum surface, thus often causing black lines on the image during multi-sheet copying. Moreover, when multiple sheets of copied image are stored in piles, the toner undesirably tends to transfer to the back causing so-called setoff. A toner containing an ester wax having a Vickers hardness higher than 5.0 is also not preferable since excessive pressure is required for the fixing assembly of heat and pressure fixing, necessitating the fixing assembly to have much strength. When a normal-pressure fixing assembly is used for such a toner, the anti-offset properties tend to deteriorate.

The ester wax may include the following ester compounds.

- Ester Compound A -

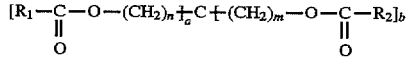

wherein a and b are each an integer of 0 to 4, provided that a+b is 4; $R_1$ and $R_2$ are each an organic group having 1 to 40 carbon atoms, provided that a difference of the number of carbon atoms between $R_1$ and $R_2$ is 3 or more; and m and n are each an integer of 0 to 25, provided that m and n are not 0 at the same time.

- Ester Compound B -

$$[R_1-\underset{\underset{O}{\|}}{C}-O-(CH_2)_n\underset{a}{\}}C+(CH_2)_m-OH]_b$$

wherein a is an integer of 0 to 4 and b is an integer of 1 to 4, provided that a+b is 4; $R_1$ is an organic group having 1 to 40 carbon atoms; and m and n are each an integer of 0 to 25, provided that m and n are not 0 at the same time.

- Ester Compound C -

$$[R_1-\underset{\underset{O}{\|}}{C}-O-(CH_2)_n\underset{a}{\}}\overset{(R_3)_k}{\overset{|}{C}}+(CH_2)_m-O-\underset{\underset{O}{\|}}{C}-R_2]_b$$

wherein a and b are each an integer of 0 to 3, provided that a+b is 1 to 3; $R_1$ and $R_2$ are each an organic group having 1 to 40 carbon atoms, provided that a difference of the number of carbon atoms between $R_1$ and $R_2$ is 3 or more; $R_3$ is a hydrogen atom or an organic group having 1 or more carbon atoms; provided that, when a+b is 2, one of $R_3$'s is an organic group having 1 or more carbon atoms; k is an integer of 1 to 3; and m and n are each an integer of 0 to 25, provided that m and n are not 0 at the same time.

Examples of specific ester compounds are shown below.

Ester Compound No. 1: (molecular weight: 852)

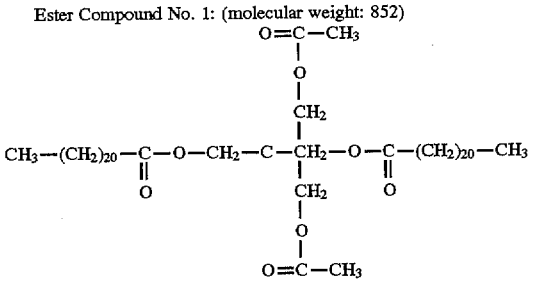

Ester Compound No. 2: (molecular weight: 626)

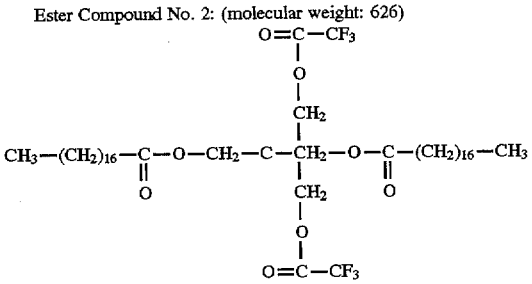

Ester Compound No. 3: (molecular weight: 972)

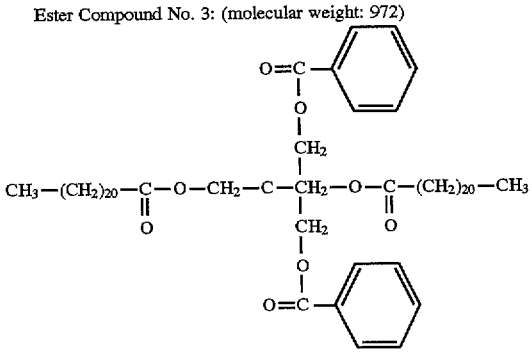

-continued

Ester Compound No. 4: (molecular weight: 1,424)

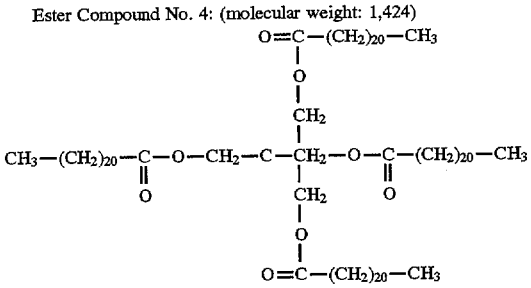

Ester Compound No. 5: (molecular weight: 1,144)

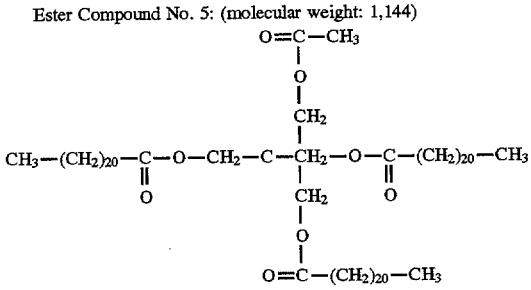

Ester Compound No. 6: (molecular weight: 1,102)

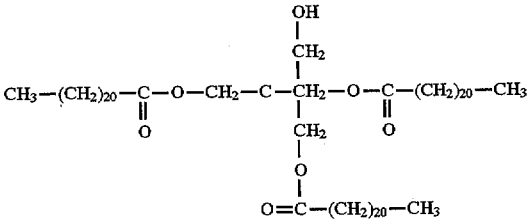

Ester Compound No. 7: (molecular weight: 1,100)

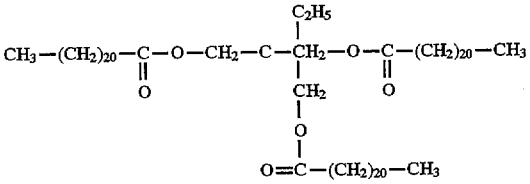

Ester Compound No. 8: (molecular weight: 748)

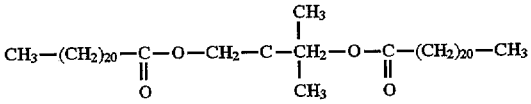

Ester Compound No. 9: (molecular weight: 748)

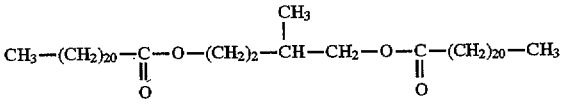

Ester Compound No. 10: (molecular weight: 584)

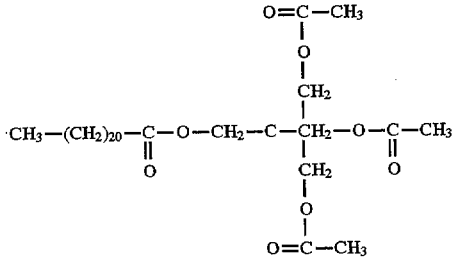

-continued

Ester Compound No. 11: (molecular weight: 1,211)

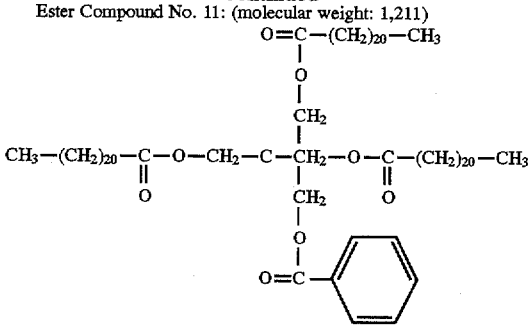

Ester Compound No. 12: (molecular weight: 770)

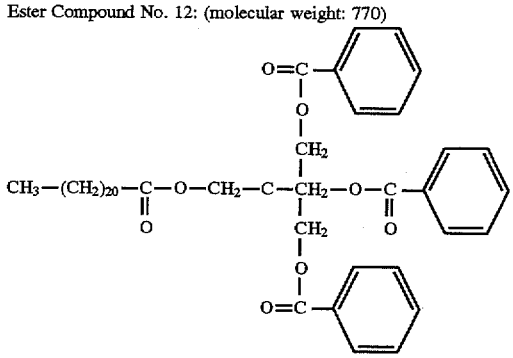

Ester Compound No. 13: (molecular weight: 536)
$CH_3-(CH_2)_{16}-COO-(CH_2)_{17}-CH_3$
Ester Compound No. 14: (molecular weight: 596)
$CH_3-(CH_2)_{18}-COO-(CH_2)_{19}-CH_3$
Ester Compound No. 15: (molecular weight: 648)
$CH_3-(CH_2)_{20}-COO-(CH_2)_{21}-CH_3$
Ester Compound No. 16: (molecular weight: 704)
$CH_3-(CH_2)_{22}-COO-(CH_2)_{23}-CH_3$ The ester wax used in the present invention may be produced by, for example, a synthesis using oxidation reaction, a synthesis from carboxylic acids and derivatives thereof, or an ester group introducing reaction as typified by the Michael addition reaction. In view of the variety of materials and the readiness of reaction, the ester wax used in the present invention may most preferably be produced by a process utilizing the reaction shown below, which is a process utilizing dehydration condensation reaction of a carboxylic acid compound with an alcohol compound, or reaction of an acid halide with an alcohol compound.

$$R_3—COOH+R_4(OH)_n \leftrightharpoons R_4(OCO—R_3)_n+nH_2O$$

$$R_3—COCl+R_4(OH)_n \leftrightharpoons R_4(OCO—R_3)_n+nHCl$$

In the formulas, $R_3$ and $R_4$ each represent an organic group.

In order to transfer the above ester equilibrium reaction to a production system, the reaction may preferably be carried out using a large excess of alcohol or using a Dean-Stark water separator in an aromatic organic solvent azeotropic with water. Ester may be formed by using the acid halide with the addition of a base as an acceptor of the acid formed as a by-product in the aromatic organic solvent.

Other waxes may be used in combination with the ester wax. Such a wax may include hydrocarbon waxes which may have a functional group.

The hydrocarbon waxes preferably usable are hydrocarbon waxes obtained by extraction fractionation of specific components from low-molecular weight alkylene polymers obtained by polymerizing alkylenes by radical polymerization under high pressure or by polymerization in the presence of a Ziegler catalyst, alkylene polymers obtained by thermal decomposition of high-molecular weight alkylene polymers, and synthetic hydrocarbons obtained by hydrogenation of distillation residues of hydrocarbons obtained by the Arge process from synthetic gases comprised of carbon monoxide and hydrogen. Hydrocarbon waxes may also be fractionated by press sweating, solvent fractionation, or a fractionation recrystallization system utilizing vacuum distillation.

The hydrocarbons, serving as a matrix, may include i) those synthesized by reacting carbon monoxide with hydrogen in the presence of a metal oxide type catalyst (usually catalysts of a two or more multiple system), as exemplified by hydrocarbons having several hundred carbon atoms (end products are finally hydrogenated) obtained by the Synthol method, the Hydrocol process (making use of a fluidized catalyst bed), or the Arge process (making use of a fixed catalyst bed) which can obtain waxy hydrocarbons in a large quantity, and ii) hydrocarbons obtained by polymerization of alkylenes such as ethylene in the presence of a Ziegler catalyst, all of which are preferable as having less branches and being saturated long straight chain hydrocarbons. Hydrocarbon waxes synthesized by the method not relying on the polymerization of alkylenes are preferred in view of their structure and their molecular weight distribution readily feasible for fractionation. The hydrocarbon waxes may have a number average molecular weight (Mn) of from 550 to 1,200, and preferably from 600 to 1,000, a weight average molecular weight (Mw) of from 900 to 4,000, and preferably from 950 to 3,000, and Mw/Mn of not more than 3.4, preferably not more than 3.0, and particularly preferably not more than 2.0. It may also have a peak in the region of molecular weight of from 900 to 4,000, and preferably from 950 to 3,000.

The hydrocarbon wax having a functional group(s) may include graft waxes and long-chain alkyl alcohol waxes.

The ester wax and the hydrocarbon wax may be preferably mixed so that GPC pattern have maximal values in the region of molecular weight of from 350 to 850 and in the region of molecular weight of from 900 to 4,000.

Usually the ester wax and the hydrocarbon wax may preferably be mixed in a weight ratio of from 5:95 to 95:5, and more preferably from 10:90 to 90:10.

The wax composition may be mixed with the binder resin in an amount of from 1 to 40 parts by weight, and preferably from 2 to 30 parts by weight, based on 100 parts by weight of the binder resin.

When the toner is produced by polymerization method in which toner particles are directly obtained by polymerizing a monomer composition having polymerizable monomers, a colorant and the wax composition, the wax composition may preferably be used in an amount of from 10 to 40 parts by weight, and more preferably from 15 to 30 parts by weight, based on 100 parts by weight of the polymerizable monomers. Accordingly, the toner produced by polymerization may contain the wax composition in an amount of from 10 to 40 parts by weight, and preferably from 15 to 30 parts by weight.

When the toner is produced by a dry process in which a mixture of a binder resin, a colorant and the wax composition is melt-kneaded, followed by cooling, pulverization and then classification to obtain toner particles, the wax composition may preferably be used in an amount of from 1 to 10 parts by weight, and more preferably from 2 to 7 parts by weight, based on 100 parts by weight of the binder resin.

Figure 3:
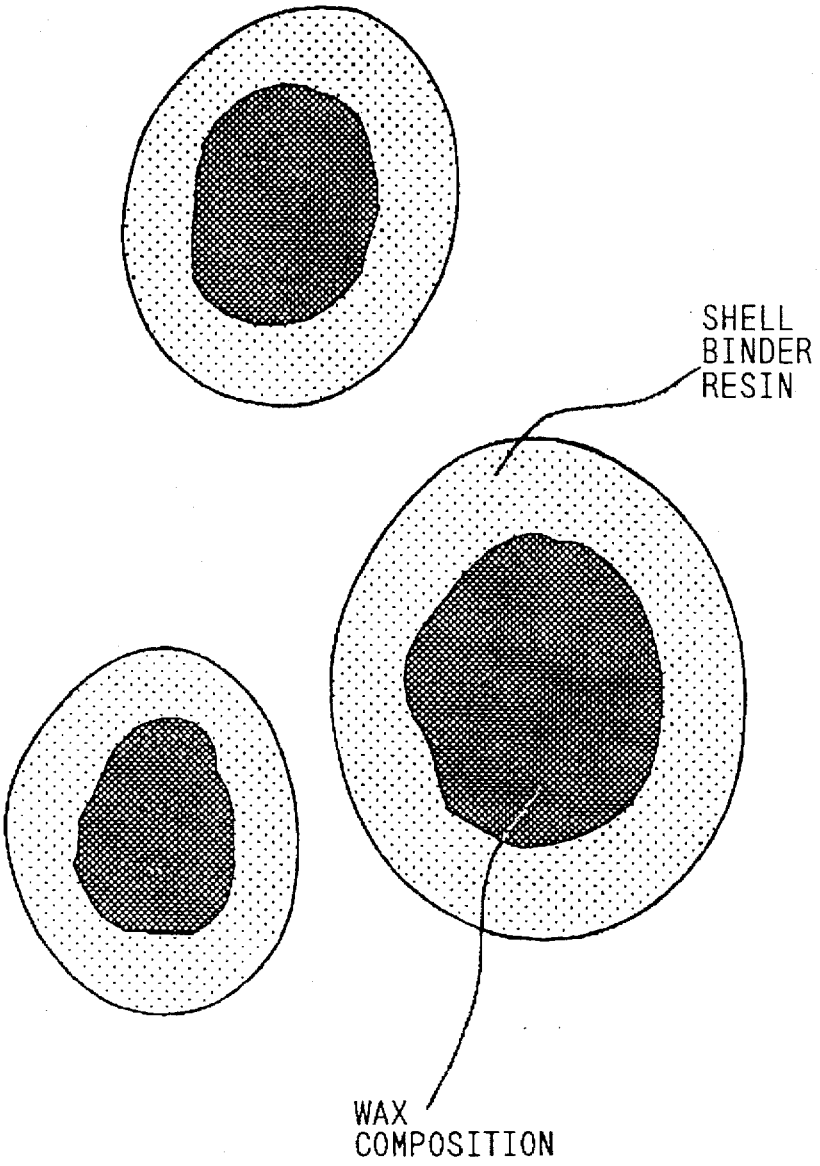
FIG. 3 diagrammatically illustrates cross sections of toner particles.

In the polymerization method, the wax composition can be efficiently encapsulated into toner particles as shown in FIG. 3. Hence a large quantity of the wax composition can be incorporated into toner particles without lowering blocking resistance.

Compared with the dry process, the polymerization method enables the toner to contain more wax, which can effectively prevent the offset during fixing, since usually the wax composition can be encapsulated into toner particles in a large quantity when the polymerization is carried out in an aqueous medium.

If the wax composition is added in an amount less than the lower limit, the toner tends to become less effective for preventing offset. If the wax composition is added in an amount more than the upper limit, the toner tends to become less effective in preventing blocking and offset prevention with the tendency of melt adhesion to the photosensitive member and the developing sleeve. The toner produced by polymerization tends to have a broad particle size distribution.

In order to obtain OHP film images having sufficient transparency with low heat application, it is preferable to decrease the crystallizability of the wax composition incorporated into toner particles. The presence of grain boundaries of partly undissolved toner, which has not dissolved even after fixing, or the high crystallizability of the wax composition may cause a decrease in effective light transmission because of irregular reflection, resulting in deterioration haze.

When the irregular reflection of light increases the brightness of projected images and the sharpness of colors decrease. Especially when a transmission overhead projector is used, such difficulties become more remarkable than with a reflection overhead projector.

As the binder resin used in the toner of the present invention, the following binder resins may be used.

For example, usable ones are homopolymers of styrene or derivatives thereof such as polystyrene poly-p-chlorostyrene and polyvinyltoluene; styrene copolymers such as a styrene-p-chlorostyrene copolymer, a styrene-vinyltoluene copolymer, a styrene-vinylnaphthalene copolymer, a styrene-acrylate copolymer, a styrene-methacrylate copolymer, a styrene-methyl α-chloromethacrylate copolymer, a styrene-acrylonitrile copolymer, a styrene-methyl vinyl ether copolymer, a styrene-ethyl vinyl ether copolymer, a styrene-methyl vinyl ketone copolymer, a styrene-butadiene copolymer, a styrene-isoprene copolymer and a styrene-acrylonitrile-indene copolymer; polyvinyl chloride, phenol resins, natural resin modified phenol resins, natural resin modified maleic acid resins, acrylic resins, methacrylic resins, polyvinyl acetate, silicone resins, polyester resins, polyurethane resins, polyamide resins, furan resins, epoxy resins, xylene resins, polyvinyl butyral, terpene resins, cumarone indene resins, and petroleum resins. Preferred binder resins include styrene copolymers and polyester resins.

Comonomers copolymerizable with styrene monomers in the styrene copolymers may include monocarboxylic acids having a double bond and derivatives thereof as exemplified by acrylic acid, methyl acrylate, ethyl acrylate, butyl acrylate, dodecyl acrylate, octyl acrylate, 2-ethylhexyl acrylate, phenyl acrylate, methacrylic acid, methyl methacrylate, ethyl methacrylate, butyl methacrylate, octyl methacrylate, acrylonitrile, methacrylonitrile and acrylamide; dicarboxylic acids having a double bond and derivatives thereof as exemplified by maleic acid, butyl maleate, methyl maleate and dimethyl maleate; vinyl esters as exemplified by vinyl chloride, vinyl acetate and vinyl benzoate; olefins as exemplified by ethylene, propylene and butylene; vinyl ketones as exemplified by methyl vinyl ketone and hexyl vinyl ketone; and vinyl ethers as exemplified by methyl vinyl ether, ethyl vinyl ether and isobutyl vinyl ether. Any of these vinyl monomers may be used alone or in combination of two or more.

The molecular weight of the binder resin is measured by gel permeation chromatography (GPC). A specific method for the measurement by GPC may include the following method: The toner is beforehand extracted with toluene for 20 hours by means of a Soxhlet extractor, and thereafter the toluene is evaporated from the extract by means of a rotary evaporator, followed by with an organic solvent capable of dissolving the ester wax but dissolving no binder resan (e.g., chloroform) Thereafter the extract is dissolved in an (THF) and filtered with a solvent-resistant membrane filter with a pore diameter of 0.3 μm to obtain a sample. Molecular weight of the sample is measured using 150C, available from Waters Co., with serially connected A-801, 802, 803, 804, 805, 806 and 807 columns (products of Showa Denko Co.) referring to a calibration curve of standard polystyrene resins.

The THF-soluble matter of the binder resin may preferably have a number average molecular weight of from 3,000 to 1,000,000.

The styrene polymers or styrene copolymers may be cross-linked, or a mixed resin of these may also be used.

As a cross-linking agent of the binder resin, compounds having at least two polymerizable double bonds may be used, including, for example, aromatic divinyl compounds such as divinyl benzene and divinyl naphthalene; carboxylic acid esters having two double bonds such as ethylene glycol diacrylate, ethylene glycol dimethacrylate and 1,3-butanediol dimethacrylate; divinyl compounds such as divinyl aniline, divinyl ether, divinyl sulfide and divinyl sulfone; and compounds having at least three vinyl groups. Any of these may be used alone or in the form of a mixture. The cross-linking agent may be added in an amount of from 0.001 to 10 parts by weight based on 100 parts by weight of the binder resin.

In the present invention, it is especially preferable that the wax composition is encapsulated by the binder resin. For this purpose, it is effective to add a polar resin to toner particles. As the polar resin, copolymers of styrene with acrylic or methacrylic acid, maleic acid copolymers, saturated polyester resins and epoxy resins are preferably used in the present invention. Particularly preferable polar resin may be those having no unsaturated groups which can react with the binder resin or monomers. If a polar resins having unsaturated groups is employed excessive cross-linking reaction will occur with the monomers that form the binder resin, lowering the color-mixing properties undesirably.

As black colorants used in the present invention, carbon black, magnetic materials, and colorants toned in black by the use of yellow, magenta and cyan colorants shown below are used.

As the yellow colorant, compounds typified by condensed azo compounds, isoindolinone compounds, anthraquinone compounds, azo metal complexes, methine compounds and allylamide compounds. Stated specifically, C.I. Pigment Yellow 12, 13, 14, 15, 17, 62, 74, 83, 93, 94, 95, 97, 109, 110, 111, 120, 127, 128, 129, 147, 168, 174, 176, 180, 181, 191, etc., are preferably used.

As the magenta colorant, condensed azo compounds, diketopyrrolopyrrole compounds, anthraquinone, quinacridone compounds, basic dye chelate compounds, naphthol compounds, benzimidazolone compounds, thioindigo compounds and perylene compounds are used. Stated specifically, C.I. Pigment Red 2, 3, 5, 6, 7, 23, 48:2, 48:3, 48:4, 57:1, 81:1, 144, 146, 166, 169, 177, 184, 185, 202, 206, 220, 221 and 254 are particularly preferable.

As the cyan colorant, copper phthalocyanine compounds and derivatives thereof, anthraquinone compounds and basic dye chelate compounds may be used. Stated specifically, C.I. Pigment Blue 1, 7, 15:1, 15:2, 15:3, 15:4, 60, 62, 66, etc. may be particularly preferably used.

These colorants may be used alone, in the form of a mixture, or in the state of a solid solution. The colorants used in the present invention are selected taking account of hue angle, chroma, brightness, weatherability, transparency on OHP films and dispersibility in toner particles. The colorant may usually be added in an amount of from 1 to 20 parts by weight based on 100 parts by weight of the binder resin.

When a magnetic material is used as the black colorant, it is usually used in an amount of from 40 to 150 parts by weight based on 100 parts by weight of the binder resin, differing from the other colorant.

The toner of the present invention may contain a magnetic material so that it can be used as a magnetic toner. In this case, the magnetic material may also serve as the colorant. In the present invention, the magnetic material contained in the magnetic toner may include iron oxides such as magnetite, hematite and ferrite; magnetic metals such as iron, cobalt and nickel, or alloys of any of these metals with a metal such as aluminum, cobalt, copper, lead, magnesium, tin, zinc, antimony, beryllium, bismuth, cadmium, calcium, manganese, selenium, titanium, tungsten or vanadium, and mixtures of any of these.

The magnetic material used in the present invention may preferably be a surface-modified magnetic material. When used in the toner produced by polymerization, any materials may be used so long as they have been subjected to hydrophobic treatment with a surface modifier which is a substance having no polymerization inhibitory action. Such a surface modifier may include, for example, silane coupling agents and titanium coupling agents.

These magnetic materials may preferably be those having an average particle diameter of 1 μm or less, and preferably from 0.1 to 0.5 μm.

The magnetic material may preferably be those having a coercive force (Hc) of from 20 to 300 oersted, a saturation magnetization ($\sigma s$) of from 50 to 200 emu/g and a residual magnetization (or) of from 2 to 20 emu/g, as magnetic characteristics under application of 10K oersted.

As a charge control agent used to stabilize triboelectric chargeability of the toner, it is preferable to use a charge control agent that is colorless, provides the toner a high charging speed and a constant charge quantity. When the direct polymerization method is used in the present invention, the charge control agents having no polymerization inhibition nor solubility in an aqueous medium are particularly preferred. As specific compounds, metal compounds of salicylic acid, alkyl salicylic acids, dialkyl salicylic acids, naphthoic acid or dicarboxylic acids, polymer type compounds having sulfonic acid or carboxylic acid in the side chain, boron compounds, urea compounds, silicon compounds, karixarene and so forth may be used as negative charge control agents. As positive charge control agents, quaternary ammonium salts, polymer type compounds having such a quaternary ammonium salt in the side chain, guanidine compounds, imidazole compounds and so forth may preferably be used. The charge control agent may preferably be added in a amount of from 0.5 to 10 parts by weight based on 100 parts by weight of the binder resin. In the present invention, however, the addition of the charge control agent is not essential. When two-component development is employed, the triboelectric charging with a carrier may be utilized, and also when non-magnetic one-component blade coating development is employed, the triboelectric charging with a blade member or sleeve member may be intentionally utilized. In either case, the charge control agent may not necessarily be contained in toner particles.

Additives used in the toner may preferably have a particle diameter of not more than ⅕ of the volume average diameter of toner particles in view of their durability when added into the toner particles or externally added to the toner particles. This particle diameter of the additives means the average particle diameter measured by observing the surface of the toner particles using an electron microscope. For example, followings are used as the additives to provide various properties.

As fluidity-providing agents, metal oxides such as silicon oxide, aluminum oxide and titanium oxide, carbon black, and carbon fluoride may be used. These may more preferably be subjected to hydrophobic treatment.

As abrasives, metal oxides such as cerium oxide, aluminum oxide, magnesium oxide and chromium oxide, nitrides such as silicon nitride, carbides such as silicon carbide, and metal salts such as strontium titanate, calcium sulfate, barium sulfate and calcium carbonate may be used.

As lubricants, fluorine resin powders such as vinylidene fluoride and polytetrafluoroethylene, and fatty acid metal salts such as zinc stearate and calcium stearate may be used.

As charge controlling particles, metal oxides such as tin oxide, titanium oxide, zinc oxide, silicon oxide and aluminum oxide, and carbon black.

Any of these additives may be used in an amount of from 0.1 part to 10 parts by weight, and preferably from 0.1 part to 5 parts by weight, based on 100 parts by weight of the toner particles. These additives may be used alone or in combination.

To achieve higher image quality and faithful development of minute latent dots, the toner may preferably have a weight average particle diameter of from 3 μm to 8 μm and a number variation coefficient of 35% or less, measured using Coulter counter. A toner having a weight average particle diameter less than 3 μm may have a low transfer efficiency and much untransferred toner may remain on the photosensitive member or intermediate transfer member, leading to uneven images due to fog and faulty transfer. A toner having a weight average particle diameter greater than 8 μm may lower the resolution or dot reproducibility and also may cause toner adhesion to various members. This tendency increases when the toner has a number variation coefficient greater than 35%.

When the toner is produced by pulverization, the binder resin, the wax composition, the pigment or dye as the colorant, the magnetic material, and optionally the charge control agent and other additives are thoroughly mixed using a mixing machine such as a Henschel mixer or a ball mill, and then the mixture is melt-kneaded using a heat kneading machine such as a heating roll, a kneader or an extruder to make the metal compound, the pigment, the dye and the magnetic material disperse or dissolve in the melted and dissolved resin etc., followed by cooling for solidification and thereafter pulverization and classification. Thus the toner can be obtained.

If necessary, any desired additives may be further thoroughly mixed with the toner using a mixing machine such as a Henschel mixer. Thus, the toner for developing electrostatic images according to the present invention can be obtained.

As other methods for producing the toner, the toner can also be produced by the method disclosed in Japanese Patent Publication No. 56-13945 in which a molten mixture is atomized or sprayed in the air by means of a disk or multiple fluid nozzles to obtain a spherical toner; the method disclosed in Japanese Patent Publication No. 36-10231 and Japanese Patent Applications Laid-open No. 59-53856 and No. 59-61842 in which toners are directly produced by suspension polymerization; a dispersion polymerization method in which toners are directly produced using an aqueous organic solvent in which monomers are soluble but formed polymers are insoluble; or an emulsion polymerization method as typified by soap-free polymerization in which toner particles are produced by direct polymerization in the presence of a water-soluble polar polymerization initiator.

By the pulverization method for producing toner particles, it is difficult to control the shape of toner particles. By melt-spraying method, those having a broad particle size distribution tend to be produced and energy consumption is large in the production steps, in particular, in the melting step. Hence, this method is not preferable also in view of energy utilization efficiency.

By the dispersion polymerization, the toner obtained shows a very sharp particle size distribution. This method, however, has the problems that the selection range for materials to be used is narrow and that the production apparatus tends to become complicated and troublesome considering the disposal of waste organic solvent or flammability of the organic solvent used in the production steps. The emulsion polymerization as typified by soap-free polymerization is useful since the produced toner can have a relatively uniform particle size distribution, but sometimes it causes environmental problems since the emulsifying agent or initiator terminals remains on the surface of the toner particles.

Therefore, suspension polymerization is particularly preferable to produce the toner used in the present invention, which enables relatively uniform control of the shape of toner particles, can achieve a sharp particle size distribution with ease and also can readily obtain a fine-particle toner having a small particle diameter of from 3 to 8 μm. Seed polymerization, in which monomers are further adsorbed on the preformed polymer particles and thereafter a polymerization initiator is added to carry out polymerization, may also be preferably employed in the present invention. In this polymerization, polar compounds can be dispersed or dissolved in the monomers to be adsorbed on the particles.

When the suspension polymerization is employed to produce the toner of the present invention, toner particles can be directly produced as described below. A monomer composition is prepared by adding a wax composition, a colorant, a charge control agent, a polymerization initiator and other additives in monomers, followed by uniform dissolving or dispersing by means of a homogenizer, an ultrasonic dispersion machine or the like. The monomer composition is dispersed in an aqueous medium containing a dispersion stabilizer, by means of a conventional stirrer, or a homomixer, a homogenizer or the like. Granulation is carried out preferably while controlling the stirring speed and time so that droplets of the monomer composition can have the desired toner particle size. After the granulation, stirring may be carried out to such an extent that the state of particles is maintained and the particles can be prevented from settling by the action of the dispersion stabilizer. The polymerization may be carried out at a polymerization temperature set at 40° C. or above, usually from 50° to 90° C. At the latter half of the polymerization, the temperature may be raised, and also the aqueous medium may be removed in part at the latter half of the reaction or after the reaction has been completed, in order to remove the not reacted polymerizable monomers, by-products and so forth that may generate an odor when toner images are fixed. After the reaction has been completed, the toner particles formed are collected with washing and filtration, followed by drying.

When the toner particles are directly obtained by polymerization, the polymerizable monomers include styrene; styrene monomers such as o-, m- or p-methylstyrene and m- or p-ethylstyrene; acrylate or methacrylate monomers such as methyl acrylate or methacrylate, ethyl acrylate or methacrylate, propyl acrylate or methacrylate, butyl acrylate, or methacrylate, octyl acrylate or methacrylate, dodecyl acrylate or methacrylate, stearyl acrylate or methacrylate, behenyl acrylate or methacrylate, 2-ethylhexyl acrylate or methacrylate, dimethylaminoethyl acrylate or methacrylate, and diethylaminoethyl acrylate or methacrylate; and olefin monomers such as butadiene, isoprene, cyclohexene, acrylo- or methacrylonitrile, and acrylic acid amide In the present invention, in order to form a core-shell structure as shown in FIG. 3, it is preferable to use a polar resin as previously mentioned. Polar polymers and polar copolymers usable in the present invention are shown below as its more specific examples.

It may include polymers of monomers selected from nitrogen-containing monomers such as dimethylaminoethyl methacrylate and diethylaminoethyl methacrylate, nitrile monomers such as acrylonitrile, halogen-containing monomers such as vinyl chloride, unsaturated carboxylic acid monomers such as acrylic acid and methacrylic acid, unsaturated dibasic acid monomers, unsaturated dibasic acid anhydride monomers, and nitro monomers; or copolymers of such monomers with styrene or styrene monomers. More preferred examples are a copolymer of styrene with acrylic or methacrylic acid, a styrene-maleic acid copolymer, unsaturated polyester resins and epoxy resins.

The polymerization initiator may include, for example, azo or diazo type polymerization initiators such as 2,2'-azobis-(2,4-dimethylvaleronitrile), 2,2'-azobisisobutyronitrile), 1,1'-azobis-(cyclohexane-1-carbonitrile), 2,2'-azobis-4-methoxy-2,4-dimethylvaleronitrile and azobisisobutyronitrile; and peroxide type initiators or polymeric initiators having a peroxide in the side chain, such as benzoyl peroxide, methyl ethyl ketone peroxide, diisopropylperoxy carbonate, cumene hydroperoxide, t-butyl hydroperoxide, di-t-butyl hydroperoxide, dicumyl peroxide, 2,4-dichlorobenzoyl peroxide, lauroyl peroxide, 2,2-bis(4,4-t-butylperoxycyclohexyl)propane, and tris-(t-butoxyperoxy) triazine; persulfates such as potassium persulfate and ammonium persulfate; and hydrogen peroxide. Any of these may be used alone or in the form of a mixture.

The polymerization initiator may preferably be used in an amount of from 0.5 to 20 parts by weight based on 100 parts by weight of the polymerizable monomers.

In the present invention, in order to control molecular weight, any known cross-linking agent and chain transfer agent may be added, which may preferably be added in an amount of from 0.001 to 15 parts by weight based on 100 parts by weight of the polymerizable monomers.

In the present invention, when the toner is produced by emulsion polymerization, dispersion polymerization, suspension polymerization, seed polymerization, or heterogeneous agglomeration, the dispersion medium used therein contains a suitable dispersion stabilizer. For example, as inorganic compounds, it may include tricalcium phosphate, magnesium phosphate, aluminum phosphate, zinc phosphate, calcium carbonate, magnesium carbonate, calcium hydroxide, magnesium hydroxide, aluminum hydroxide, calcium metasilicate, calcium sulfate, barium sulfate, bentonite, silica and alumina. As organic compounds, it may include polyvinyl alcohol, gelatin, methyl cellulose, methyl hydroxypropylcellulose, ethyl cellulose, carboxymethyl cellulose sodium salt, polyacrylic acid and salts thereof, starch, polyacrylamide, polyethylene oxide, a poly(hydroxystearic acid-g-methyl methacrylate-eu-acrylic acid) copolymer, and nonionic or ionic surface active agents.

In the cases of the emulsion polymerization and the polymerization carried out by heterogeneous agglomeration, anionic surface active agents, cationic surface active agents, amphoteric surface active agents and nonionic surface active agent are used. Any of these dispersion stabilizers may preferably be used in an amount of 0.2 to 30 parts by weight based on 100 parts by weight of the polymerizable monomers.

As these dispersion stabilizers, those commercially available may be used as they are. In order to obtain dispersed particles having a fine and uniform particle size, however, the inorganic compound may also be formed in the dispersion medium under high-speed stirring. For example, in the case of tricalcium phosphate, an aqueous sodium phosphate solution and an aqueous calcium chloride solution may be mixed under high-speed stirring, whereby a dispersion stabilizer preferable for the suspension polymerization can be obtained. In order to make particles of these dispersion stabilizers finer, 0.001 to 0.1% by weight of a surface active agent may be used in combination. Stated specifically, commercially available nonionic, anionic or cationic surface active agents can be used. For example, those preferably used are sodium dodecylsulfate, sodium tetradecylsulfate, sodium pentadecylsulfate, sodium octylsulfate, sodium oleate, sodium laurate, potassium stearate and calcium oleate.

Concerning the colorant used in the polymerization toner, attention must be paid to its polymerization inhibitory action or aqueous-phase transfer properties. It is preferable to carry out the surface modification of the colorant, for example, hydrophobic treatment makes the colorants free from polymerization inhibiting property. In particular, most dye type colorants and carbon black have the polymerization inhibitory action and hence care must be taken when used. One of the preferable surface treating methods for dyes is to previously polymerize the polymerizable monomer in the presence of the dye. The resulting colored polymer is added to the monomer composition. With regard to the carbon black, besides the same treatments for the dyes, it may be treated with a material capable of reacting with surface functional groups of the carbon black, as exemplified by polyorganosiloxane.

A more preferred toner is, as previously stated, the toner whose particles each have a capsule structure as shown in FIG. 3, a core formed from the wax composition and the shell of binder resin when the cross section of the toner particle is observed using a transmission electron microscope (TEM). This structure of the toner particles is preferable for satisfactory low-temperature fixing performance, blocking resistance and durability of the toner.

A toner not enclosing the wax composition is not desirable, since it can not be finely pulverized unless special freeze pulverization is employed in the step of pulverization, so that the toner has a broad particle size distribution, and in some instances it may adhere to assemblies. The freeze pulverization has problems that assemblies may become complicated to take a measure to prevent condensation or, since the toner absorbed moisture lowers the workability in the toner production, additional drying step may be required in some instances. As a method for encapsulating the wax composition, the combination use of a polymerizable monomer for the binder resin and a small quantity of a polar resin or monomers of higher polarity in an aqueous medium can give the toner having a core-shell structure, where the wax composition, even though having a strong polarity, is covered with the shell binder resin. The particle size distribution and particle diameters of the toner can be controlled by changing the type and amount of the slightly water soluble inorganic salt or the dispersant acting as protective colloids, or by controlling mechanical device conditions, for example, stirring conditions such as rotor peripheral speed, pass time and stirring blade shape, and the shape of containers or the solid matter concentration in the aqueous solution, whereby the intended toner of the present invention can be obtained.

As a specific method for studying the cross sections of toner particles in the present invention, toner particles are well dispersed in an epoxy resin curable at room temperature, followed by curing in an environment of temperature 40° C. for 2 days, and the cured product is dyed with triruthenium tetraoxide, and if necessary, with triosmium tetraoxide in combination. Thereafter, samples are cut into slices by means of a microtome having a diamond cutter to measure the cross sectional forms of the toner particles using a transmission electron microscope (TEM). In the present invention, it is preferable to use the triruthenium tetraoxide dyeing method to give a contrast between the materials utilizing the difference in the crystallinity of the wax composition and the binder resin constituting the shell.

The toner of the present invention can be used as a toner for one-component developers, or as a toner for two-component developers.

As one-component development methods, there is a method to use a magnetic toner containing a magnetic material in the particles. The toner is transported and electrostatically charged by means of a developing sleeve provided with a magnet inside. When a non-magnetic toner containing no magnetic material is used in one-component system, the toner may be transported attaching to the developing sleeve, which is caused by forced triboelectrically charging of the toner on a developing sleeve, using a coating blade, a coating roller or a fur brush.

As for the case of two-component developers, a carrier is used together with the toner of the present invention. There are no particular limitations on the carrier used. Principally, a magnetic carrier made from solely iron, copper, zinc, nickel, cobalt, manganese or chromium element or a magnetic ferrite carrier produced by mixture of some of these is preferred. The shape of carrier particles is also important considering the advantage that the saturation magnetization and electrical resistivity can be controlled within a wide range. For example, the shape can be chosen from spherical, flat or amorphous, and also it is preferable to control the microstructure of carrier particle surfaces (e.g., surface unevenness). To control the surface microstructure of the carrier particles, a common method is to previously fire and granulate inorganic oxide to produce carrier core particles, which are thereafter coated with resin. To decrease the load of carrier to toner, it is also possible to use a method in which an inorganic oxide and the resin are kneaded, followed by pulverization and classification to obtain a dispersed carrier of low density, or a method for obtaining a polymerization carrier in which a kneaded product of an inorganic oxide and monomers is subjected to suspension polymerization in an aqueous medium to directly obtain a true-spherical dispersed carrier.

A coated carrier of which carrier particles are coated with resin is particularly preferred. As a method therefor, a resin dissolved or suspended in a solvent may be coated to make it adhere to carrier particles, or the resin and the carrier are merely mixed in a powder form.

The coating material for the carrier particle surfaces may differ depending on the toner materials. For example, it is suitable to use, alone or in combination, polytetrafluoroethylene, monochlorotrifluoroethylene, polyvinylidene fluoride, silicone resin, polyester resin, styrene resin, acrylic resin, polyamide, polyvinyl butyral, Nigrosine, aminoacrylate resin or the like.

Usually, such a coating material may preferably be used in an amount of from 0.1 to 30% by weight, and more preferably from 0.5 to 20% by weight, in total based on the weight of the carrier.

The carrier may preferably have an average particle diameter of from 10 to 100 μm, and more preferably from 20 to 50 μm.

A typical carrier is, for example, it is a coated ferrite carrier comprising Cu—Zn—Fe three-component ferrite particles containing 70% by weight or more of 250 mesh-pass and 400 mesh-on carrier particles and having the above average particle diameter, whose surfaces are coated with a mixture of resins such as a fluorine resin and a styrene resin (e.g., polyvinylidene fluoride and styrene-methyl methacrylate resin, polytetrafluoro-ethylene and styrene-methyl methacrylate resin, a fluorine type copolymer and a styrene type copolymer, or the like in a mixing ratio of from 90:10 to 20:80, and preferably from 70:30 to 30:70) in a coating weight of from 0.01 to 5% by weight, and preferably from 0.1 to 1% by weight. The fluorine type copolymer is exemplified by a vinylidene fluoride-tetrafluoroethylene copolymer (10:90 to 90:10) and the styrene type copolymer is exemplified by a styrene-2-ethylhexyl acrylate-methyl methacrylate copolymer (20 to 60:5 to 30:10 to 50).

The above coated ferrite carrier can provide a triboelectric chargeability preferable for the toner of the present invention, and also is effective for improving electrophotographic performances.

When the two-component developer is prepared by blending the toner and the carrier, good results can be obtained when they are blended in a proportion where the toner concentration is from 2% by weight to 15% by weight, and preferably from 4% by weight to 13% by weight in the developer.

The magnetic carrier may preferably have the following magnetic properties. Magnetization intensity under 1,000 oersted ($\sigma$1,000) after having been magnetically saturated is preferably from 30 to 300 emu/cm$^3$. In order to achieve a higher image quality, it is more preferably from 100 to 250 emu/cm$^3$. If it is greater than 300 emu/cm$^3$, it becomes difficult to obtain toner images with a high image quality. If it is less than 300 emu/cm$^3$, carrier adhesion tends to occur because of the decrease in magnetic restraint force.

Fixing performance, anti-offset properties, color-mixing region, and transparency are evaluated in the following way.

1) Fixing performance, anti-offset properties, and color-mixing region

Unfixed toner images are formed using a commercially available copying machine.

When the toner is a black toner, the fixing performance and anti-offset properties are evaluated by means of an external heat roller fixing assembly having no oil application mechanism.

In the case of a toner for mono-color or toners for full colors, the fixing performance, anti-offset properties and color mixing region are evaluated by means of an external heat roller fixing assembly having no oil application mechanism, or a fixing assembly of a digital full-color copying machine CLC-500 (Canon Inc.) where a little oil (e.g., 0.02 g/A4 size) is evenly applied to the fixing rollers. Fixed images for evaluating transparency are also formed.

As materials for the rollers used here, fluorine resin or rubber surface layers are used for the upper roller and the lower roller.

A fixing assembly having an upper roller and a lower roller each having a roller diameter of about 60 mm is used as the heat roller external fixing assembly. When the transfer medium is, for example, SK paper (available from Nippon Seishi K.K.), fixing is carried out under conditions of a nip of 6.5 mm and a process speed of 105 mm/sec under temperature regulation of from 80° C. to 230° C. at intervals of 5° C. When the transfer medium is, for example, OHP sheet (trade name: CG3300, available from Sumitomo 3M Limited), fixing is carried out under conditions of a nip of 6.5 mm and a process speed of 25 mm/sec at a temperature of 150° C.

To examine the fixing performance, the fixed images (low-temperature offset images are also included) are rubbed with Silbon paper, lens cleaning paper "DASPER" (trade name; Ozu Paper Co., Ltd.) under load application of 50 g/cm$^2$, and the temperature at which the decrease of image density after the rubbing is first less than 10% is regarded as the fixing starting temperature.

With regard to the anti-offset properties, the temperature at which offset becomes no longer seen in visual observation during temperature lowering is regarded as the low-temperature offset starting point, and, with temperature rise the maximum temperature at which the offset still does not occur is regarded as high-temperature offset end point.

With regard to the color-mixing region, gloss of images present in offset-free regions is measured using a handy glossmeter Gloss Checker IG-310 (manufactured by Horiba Seisakusho), and the color mixing region is defined to be a gloss value of 7 or more up to the maximum value to determine the region.

2) Transparency

Transmittance and cloudiness (haze) at each image density of the fixed images obtained are measured, and the transparency is evaluated on the basis of the numerical value at image density 1.2. The transmittance and haze are measured in the manner described below.

The transmittance is measured using Shimadzu Automatic Spectrophotometer UV2200 (manufactured by Shimadzu Corporation). Regarding the transmittance of OHP film as 100%, transmittance was determined at following maximum absorption wavelength;

in the case of magenta toner: 650 nm;

in the case of cyan toner: 500 nm; and in the case of yellow toner: 600 nm.

The haze is measured using a hazemeter NDH-300A (manufactured by Nihon Hasshokyu Kogyo K.K.).

An image forming apparatus that can well form images using the non-magnetic toners of the present invention ( yellow, magenta, cyan or black) and the magnetic carrier will be described with reference to FIG. 4.

Figure 4:
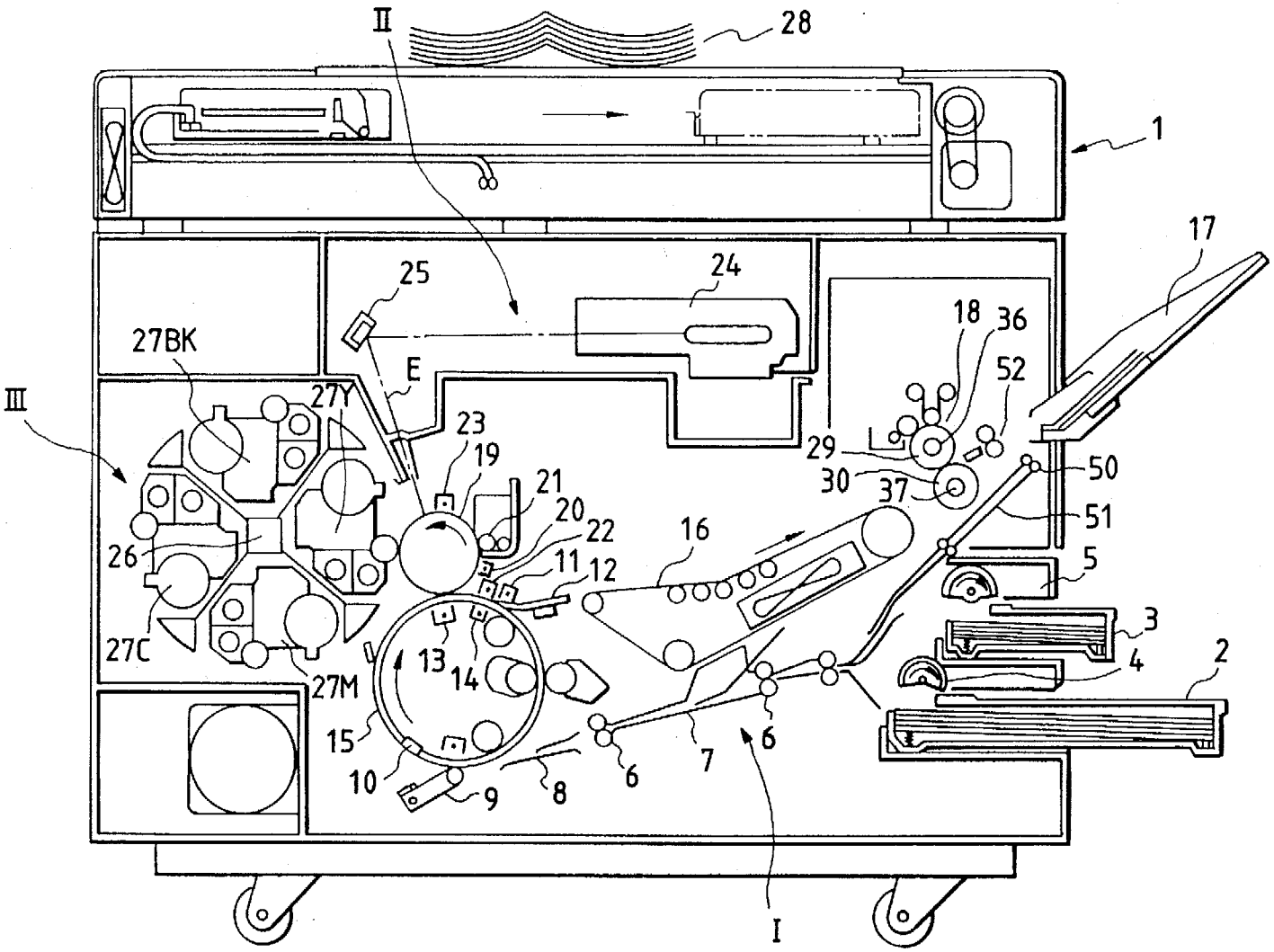
FIG. 4 schematically illustrates a full-color image forming apparatus to which a two-component type developer for magnetic brush development, having the non-magnetic toner of the present invention and a magnetic carrier, can be applied.

A full-color electrophotographic apparatus illustrated in FIG. 4 is roughly grouped into three; a transfer medium transport system I extending from the right side (the right side in FIG. 1) substantially to the middle of the main body 1 of the apparatus, a latent image forming zone II provided in substantially the middle of the main body 1 of the apparatus and in proximity to a transfer drum 15 of the transfer medium transport system I, and a developing means (i.e., a rotary developing unit) III provided in proximity to the latent image forming zone II.

The transfer medium transport system I described above has a following constitution. It has openings formed on the right side (the right side in FIG. 1) of the main body 1 of the apparatus, and in the opening provided are the transfer medium feeding trays 2 and 3 detachable through the openings partly protruding toward the outside of the apparatus. Paper feed rollers 4 and 5 are provided almost directly above the trays 2 and 3, respectively, and another paper feed roller 6 and paper guides 7 and 8 are provided in the manner that they connect the paper feed rollers 4 and 5 with the transfer drum 15 which is provided on the left side and rotatable in the direction of the arrow. A contacting roller 9, a gripper 10, a transfer medium separating charger 11 and a separating claw 12 are sequentially provided in the vicinity of the periphery of the transfer drum 15 in the direction of the rotation.

A transfer charger 13 and a transfer medium separating charger 14 are provided inside the periphery of the transfer drum 15. A transfer sheet (not shown) formed of a polymer such as polyvinylidene fluoride is stuck to the region where the transfer medium winds round the transfer drum 15, and the transfer mediums are electrostatically stuck to the surface of the transfer sheet. A paper delivery belt means 16 is provided in proximity to the separating claw 12 on upper right of the transfer drum 15, and a fixing assembly 18 is provided at the terminal (the right side) of the transfer medium transport direction of the paper delivery belt means 16. Further downstream of the fixing assembly 18, a paper output tray 17 is provided extending to the outside of the main body 1 of the apparatus, and detachable from the main body 1.

The latent image forming zone II is constructed as described below. As a latent image bearing member, a photosensitive drum (e.g. an OPC photosensitive drum) 19 rotatable in the direction of an arrow in FIG. 4 is provided in the manner that its periphery comes into contact with the periphery of the transfer drum 15. Above the photosensitive drum 19 and in the vicinity of the periphery thereof, a residual charge eliminating charger 20, a cleaning means 21 and a primary charger 23 are sequentially provided from upstream to downstream in the rotation direction of the photosensitive drum 19. An imagewise exposure means 24 such as a laser beam scanner to form an electrostatic latent image on the periphery of the photosensitive drum 19, and an imagewise exposing light reflecting means 25 such as a mirror are also provided.

The rotary developing unit III is constructed in the following way. It comprises a rotatable housing (hereinafter "rotating support") 26 provided at the position facing the periphery of the photosensitive drum 19. In the rotating support 26, four kinds of developing assemblies are mounted and are so constructed that electrostatic latent images formed on the periphery of the photosensitive drum 19 can be converted into visible images (i.e., developed). The four kinds of developing assemblies comprise a yellow developing assembly 27Y, a magenta developing assembly 27M, a cyan developing assembly 27C and a black developing assembly 27BK, respectively.

The whole sequence of the above explained image forming apparatus will be described by giving an example of full-color mode image formation. With the rotation of the above photosensitive drum 19 in the direction of the arrow in FIG. 1, a photosensitive layer on the photosensitive drum 19 is electrostatically charged by means of the primary charger 23. In the apparatus shown in FIG. 1, each component part is operated at a speed (hereinafter "process speed") of 100 mm/sec or higher, e.g., 130 to 250 mm/sec. Upon the electrostatic charging of the photosensitive drum 19 by means of the primary charger 23, imagewise exposure is carried out using laser light E modulated by yellow image signals from an original 28, so that an electrostatic latent image is formed on the photosensitive drum 19, and then the electrostatic latent image is developed by means of the yellow developing assembly 27Y previously set at the developing position by the rotation of the rotating support 26. Thus, a yellow toner image is formed.

The transfer medium transported through the paper feed guide 7, paper feed roller 6 and paper feed guide 8 is held fast by the gripper 10 at a given timing, and is electrostatically wound around the transfer drum 15 by means of the contacting roller 9 and an electrode set opposingly to the contacting roller 9. The transfer drum 15 is rotated in the direction of the arrow in FIG. 4 in synchronization with the photosensitive drum 19. The yellow toner image formed by the development with the yellow developing assembly 27Y is transferred to the transfer medium by means of the transfer charger 13 at the portion where the periphery of the photosensitive drum 19 and the periphery of the transfer drum 15 come into contact with each other. The transfer drum 15 is continued rotating without stop, and stands ready for a next color (magenta as viewed in FIG. 4).

The photosensitive drum 19 is destaticized by means of the residual charge eliminating charger 20, and is cleaned by the cleaning means 21 with a cleaning blade. Thereafter, it is again electrostatically charged by means of the primary charger 23, and is subjected to imagewise exposure according to the next magenta image signals to form an electrostatic latent image. The above rotary developing unit is rotated while the electrostatic latent image is formed on the photosensitive drum 19, until the magenta developing assembly 27M is set at the developing position, where the development is carried out using a given magenta toner. Subsequently, the process as described above is also carried out on a cyan color and a black color each. After transfer steps corresponding to the four colors have been completed, a four-color visible image formed on the transfer medium is destaticized by the chargers 22 and 14, and the transfer medium held by the gripper 6 is released therefrom. At the same time, the transfer medium is separated from the transfer drum 15 by means of the separating claw 12, and then delivered to the fixing assembly 18 by the delivery belt 16, where the image is fixed by the action of heat and pressure. Thus, the sequence of full-color print is completed and the desired full-color print image is formed on one side of the transfer medium.

EXAMPLES

The present invention will be described below in greater detail by giving Examples.

| | (by weight) |
|---|---|
| Ester compound No. 1 | 65 parts |
| Ester compound No. 5 | 15 parts |
| Ester compound No. 10 | 20 parts |

Figure 2:
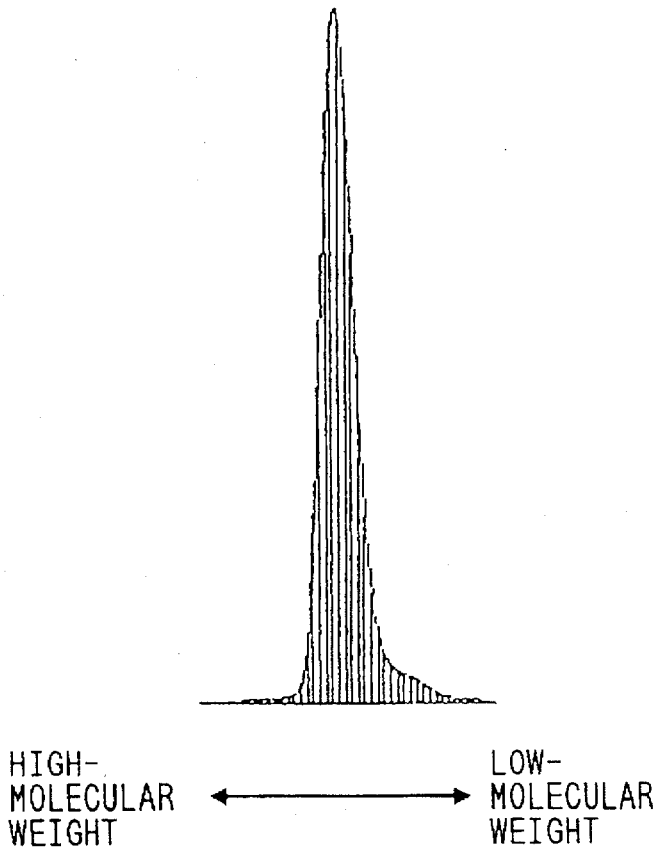
FIG. 2 shows a GPC chromatogram of Ester Wax No. 1.

The above materials were put in an attritor dispersion machine (manufactured by Mitsui Miike Engineering Corporation), followed by addition of 1,000 parts by weight of zirconium particles of 2 mm diameter were further put into it, and stirred at 200 rpm for 1 hour while heating to 90° C., to obtain ester wax No. 1. A GPC chromatogram of Ester Wax No. 1 is shown in FIG. 2. Ester Wax No. 1 had a distribution peak at a molecular weight of 800, with a weight average molecular weight (Mw) of 840, a melting point of 58° C., an SP value of 9.1, a melt viscosity of 5.0 cps at 130° C. and a Vickers hardness of 1.7.

Into the attritor dispersion machine, 35 parts by weight of the polyethylene wax shown in Table 3 (Mw: 2,800; melting point: 125° C.; Vickers hardness: 1.1) was charged, followed by stirring at a temperature of 90° C. at 200 rpm for further 1 hour. Thus, Wax Composition No. 1 was prepared.

Wax Composition No. 1, as shown in FIG. 1, had a distribution peak P1 at a molecular weight of 800, a distribution peak P2 at a molecular weight of 2,900, with Mw of 1,400, a melting point of 60° C., a melt viscosity of 5.5 cps at 130° C. and a Vickers hardness of 1.3.

Preparation of Wax Composition No. 2

| | (by weight) |
|---|---|
| Ester compound No. 3 | 5 parts |
| Ester compound No. 11 | 10 parts |
| Ester compound No. 12 | 85 parts |

Ester Wax No. 2 was prepared in the same manner as Ester Wax No. 1 except for using the above ester compounds. Wax Composition No. 2 was also prepared using Ester Wax No. 2 in the same manner as Wax Composition No. 1. The data of Wax Composition No. 2 are shown in Table 1, and the data of Ester Wax No. 2 in Table 2.

Preparation of Wax Composition No. 3

| | (by weight) |
|---|---|
| Ester compound No. 13 | 9 parts |
| Ester compound No. 14 | 21 parts |
| Ester compound No. 15 | 70 parts |

Ester wax No. 3 was prepared in the same manner as Ester Wax No. 1 except for using the above ester compounds. Wax Composition No. 3 was prepared in the same manner as Wax Composition No. 1 using Ester Wax No. 3. The data of Wax Composition No. 3 are shown in Table 1, and the data of Ester Wax No. 3 in Table 2.

Preparation of Wax Composition No. 4

Wax composition No. 4 was prepared in the same manner as Wax Composition No. 1 except that 67 parts by weight of Ester Wax No. 1 and 33 parts by weight of a styrene-modified graft polyethylene wax as shown in Table 3 were blended. The data of Wax Composition No. 4 are shown in Table 1.

Preparation of Wax Composition No. 5

Wax composition No. 5 was prepared in the same manner as Wax Composition No. 1 except that 60 parts by weight of Ester Wax No. 1 and 40 parts by weight of a long-chain alkylalcohol wax as shown in Table 3 were blended. The data of Wax Composition No. 5 are shown in Table 1.

TABLE 1

| | Ester wax content | Peaks in GPC chromatogram | | | | Melting point | * Melt viscosity | Hardness |
|---|---|---|---|---|---|---|---|---|
| | (wt. %) | P1 | P2 | Mw | Mn | (°C.) | (cps) | |
| Wax composition: | | | | | | | | |
| No.1 | 74 | 800 | 2,900 | 1,400 | 660 | 60 | 16.7 | 1.7 |
| No.2 | 74 | 790 | 2,900 | 1,400 | 650 | 59 | 16.0 | 1.5 |
| No.3 | 74 | 650 | 2,900 | 1,200 | 610 | 74 | 15.9 | 1.3 |
| No.4 | 67 | 800 | 2,100 | 1,300 | 700 | 62 | 18.9 | 3.4 |
| No.5 | 60 | 640 | 1,800 | 1,300 | 760 | 70 | 6.4 | 1.4 |

* at 130° C.

TABLE 2

| | Mw | Mn | Melting point (°C.) | SP value | Melt viscosity at 130° C. (cps) | Hardness |
|---|---|---|---|---|---|---|
| Ester wax: | | | | | | |
| No.1 | 840 | 650 | 58 | 9.1 | 5.0 | 1.7 |
| No.2 | 820 | 750 | 56 | 9.4 | 4.7 | 1.4 |
| No.3 | 630 | 590 | 73 | 8.7 | 3.9 | 1.1 |

TABLE 3

| Mw | Mn | Melting point (°C.) | SP value | Melt viscosity at 130° C. (cps) | Hardness |
|---|---|---|---|---|---|
| Polyethylene wax: | | | | | |
| 2,800 | 1,750 | 120 | 8.3 | 50 | 1.7 |
| Styrene-modified graft polyethylene wax: | | | | | |
| 2,100 | 1,400 | 105 | 9.3 | 47 | 6.8 |
| Long-chain alkylalcohol wax: | | | | | |
| 1,900 | 1,350 | 77 | 8.4 | 10 | 1.1 |

Example 1

A cyan toner was prepared as follows. Into the four-necked flask equipped with a high-speed mixer, TK homomixer, 710 parts of ion-exchanged water, 450 parts of an aqueous $Na_3PO_4$ solution (0.1 mol/liter ) were introduced, and the mixture was heated to 65° C., with stirring at 12,000 rpm. Then, 75 parts of an aqueous $CaCl_2$ solution (0.1 mol/liter) was added thereto slowly to prepare an aqueous dispersion medium containing fine-particles of $Ca_3(PO_4)_2$, a slightly water-soluble dispersion stabilizer.

| | (by weight) |
|---|---|
| Styrene monomer | 165 parts |
| n-Butyl acrylate monomer | 35 parts |
| Cyan colorant (C.I. Pigment Blue 15:3) | 14 parts |
| Polar resin [Saturated polyester (terephthalic acid/propylene oxide modified bisphenol A; acid value: 15; peak molecular weight: 6,000)] | 10 parts |

-continued

| | (by weight) |
|---|---|
| Negative charge control agent (dialkylsalicylic acid metal compound | 2 parts |
| Wax composition No. 1 | 60 parts |

Polar resin [Saturated polyester (terephthalic acid/propylene oxide modified bisphenol A; acid value: 15; peak molecular weight: 6,000] 10 parts Negative charge control agent (dialkylsalicylic acid metal compound 2 parts Wax composition No. 1 60 parts The mixture of above materials was dispersed for 3 hours by means of an attritor, and thereafter 10 parts by weight of a polymerization initiator 2,2'-azobis(2,4-dimethylvaleronitrile) was added to obtain a polymerizable monomer composition. The monomer composition was introduced into the aqueous dispersion medium to carry out granulation for 15 minutes while maintaining the revolution speed at 12,000 rpm. Thereafter, the high-speed mixer was changed to a mixer having propeller blades and the polymerization was continued for 10 hours with stirring at 250 rpm while keeping the internal temperature at 65° C. After the polymerization was completed, the slurry was cooled, and the dispersion stabilizer was remixed by adding dilute hydrochloric acid. The slurry was then washed and dried to obtain an electrically insulating cyan toner having a weight average particle diameter of 6.0 μm and a variation coefficient in number distribution of 22%. The cyan toner obtained had the capsule structure as shown in FIG. 3. The binder resin constituting the shell had a weight average molecular weight (Mw) of 61,500 and a number average molecular weight (Mn) of 15,000.

Examples 2 to 4

An electrically insulating yellow toner, an electrically insulating magenta toner and an electrically insulating black toner were obtained in the same manner as in Example 1 except that the colorant was changed to C.I. Pigment Yellow 17, C.I. Pigment Red 202 and graft carbon black, respectively.

Physical properties of the respective color toners are shown below in Table 4.

TABLE 4

| Toner | Wt. average particle diameter (μm) | * Coefficient of variation (%) | ** Wax content (pbw) | Shell resin Mw | Shell resin Mn | Volume resistivity (Ω · cm) |
|---|---|---|---|---|---|---|
| Example: | | | | | | |
| 1 Cyan | 6.0 | 22 | 28 | 61,500 | 15,000 | $\geqq 10^{14}$ |
| 2 Yellow | 6.3 | 27 | 28 | 60,500 | 14,000 | $\geqq 10^{14}$ |
| 3 Magenta | 6.2 | 24 | 28 | 62,500 | 14,500 | $\geqq 10^{14}$ |
| 4 Black | 6.1 | 23 | 28 | 63,500 | 14,000 | $\geqq 10^{14}$ |

* in number distribution
** based on 100 parts by weight of binder resin

Comparative Examples 1 to 4

A cyan toner, a yellow toner, a magenta toner and a black toner were prepared in the same manner as in Examples 1 to 4, respectively, except that Wax Composition No. 1 was replaced with 60 parts by weight of Ester Wax No. 1. Physical properties of the toners obtained are shown in Table 5.

TABLE 5

| Toner | Wt. average particle diameter (μm) | * Coefficient of variation (%) | ** Wax content (pbw) | Shell resin Mw | Shell resin Mn | Volume resistivity (Ω · cm) |
|---|---|---|---|---|---|---|
| Comparative Example: | | | | | | |
| 1 Cyan | 6.3 | 23 | 28 | 61,200 | 14,800 | $\geqq 10^{14}$ |
| 2 Yellow | 6.2 | 27 | 28 | 60,300 | 13,800 | $\geqq 10^{14}$ |
| 3 Magenta | 6.0 | 24 | 28 | 62,100 | 14,000 | $\geqq 10^{14}$ |
| 4 Black | 6.1 | 24 | 28 | 63,100 | 13,600 | $\geqq 10^{14}$ |

* in number distribution
** based on 100 parts by weight of binder resin

Comparative Examples 5 to 8

A cyan toner, a yellow toner, a magenta toner and a black toner were prepared in the same manner as in Examples 1 to 4, respectively, except that Wax Composition No. 1 was replaced with 60 parts by weight of the polyethylene wax No. 1. Physical properties of the toners thus obtained are shown in Table 6.

| Toner | Wt. average particle diameter (μm) | * Coefficient of variation (%) | ** Wax content (pbw) | Shell resin Mw | Shell resin Mn | Volume resistivity (Ω · cm) |
|---|---|---|---|---|---|---|
| Comparative Example: | | | | | | |
| 5 Cyan | 6.6 | 37 | 28 | 63,000 | 16,000 | $\geqq 10^{14}$ |
| 6 Yellow | 6.8 | 36 | 28 | 62,100 | 15,200 | $>10^{14}$ |
| 7 Magenta | 6.7 | 38 | 28 | 60,800 | 13,600 | $>10^{14}$ |
| 8 Black | 6.4 | 35 | 28 | 61,600 | 14,200 | $>10^{14}$ |

* in number distribution
** based on 100 parts by weight of binder resin

Comparative Examples 9 to 12

A cyan toner, a yellow toner, a magenta toner and a black toner were prepared in the same manner as in Examples 1 to 4, respectively, except that Wax Composition No. 1 was replaced with a montan type ester wax (available from Hoechst Japan Ltd.) mainly composed of an ester compound represented by the formula:

$$R_3—COO—(—CH_2—CH_2—)_n—OOC—R_4$$

wherein $R_3$ and $R_4$ each represent a straight-chain alkyl group having 19 to 29 carbon atoms, and n represents an integer.

Physical properties of the toners obtained are shown in Table 7.

TABLE 7

| Toner | Wt. average particle diameter (μm) | Co-* efficient of variation (%) | Wax** content (pbw) | Shell resin Mw | Shell resin Mn | Volume resistivity (Ω · cm) |
|---|---|---|---|---|---|---|
| Comparative Example: | | | | | | |
| 9 Cyan | 6.5 | 26 | 28 | 60,500 | 15,000 | ≧$10^{14}$ |
| 10 Yellow | 6.2 | 25 | 28 | 61,000 | 15,500 | ≧$10^{14}$ |
| 11 Magenta | 6.1 | 22 | 28 | 61,500 | 14,700 | ≧$10^{14}$ |
| 12 Black | 6.3 | 28 | 28 | 60,500 | 14,200 | ≧$10^{14}$ |

*in number distribution
**based on 100 parts by weight of binder resin

Comparative Examples 13 to 16

A cyan toner, a yellow toner, a magenta toner and a black toner were prepared in the same manner as in Examples 1 to 4, respectively, except that Wax Composition No. 1 was replaced with paraffin wax (Mw:550). Physical properties of the toners obtained are shown in Table 8.

TABLE 8

| Toner | Wt. average particle diameter (μm) | Co-* efficient of variation (%) | Wax** content (pbw) | Shell resin Mw | Shell resin Mn | Volume resistivity (Ω · cm) |
|---|---|---|---|---|---|---|
| Comparative Example: | | | | | | |
| 13 Cyan | 6.2 | 29 | 28 | 60,500 | 14,000 | ≧$10^{14}$ |
| 14 Yellow | 6.3 | 26 | 28 | 59,500 | 13,000 | ≧$10^{14}$ |
| 15 Magenta | 6.6 | 25 | 28 | 61,500 | 13,500 | ≧$10^{14}$ |
| 16 Black | 6.2 | 22 | 28 | 62,000 | 13,100 | ≧$10^{14}$ |

*in number distribution
**based on 100 parts by weight of binder resin

Comparative Examples 17 to 20

A cyan toner, a yellow toner, a magenta toner and a black toner were prepared in the same manner as in Examples 1 to 4, respectively, except that Wax Composition No. 1 was replaced with polypropylene wax (Mw: 6,000). Physical properties of the toners obtained are shown in Table 9.

TABLE 9

| Toner | Wt. average particle diameter (μm) | Co-* efficient of variation (%) | Wax** content (pbw) | Shell resin Mw | Shell resin Mn | Volume resistivity (Ω · cm) |
|---|---|---|---|---|---|---|
| Comparative Example: | | | | | | |
| 17 Cyan | 6.7 | 36 | 28 | 63,200 | 15,700 | ≧$10^{14}$ |
| 18 Yellow | 6.8 | 35 | 28 | 62,800 | 15,300 | ≧$10^{14}$ |

TABLE 9-continued

| Toner | Wt. average particle diameter (μm) | Co-* efficient of variation (%) | Wax** content (pbw) | Shell resin Mw | Shell resin Mn | Volume resistivity (Ω · cm) |
|---|---|---|---|---|---|---|
| 19 Magenta | 6.9 | 37 | 28 | 61,300 | 13,900 | ≧$10^{14}$ |
| 20 Black | 6.7 | 37 | 28 | 62,400 | 14,800 | ≧$10^{14}$ |

*in number distribution
**based on 100 parts by weight of binder resin

Experiment No. 1

To the cyan toner, yellow toner, magenta toner and black toner obtained in Examples 1 to 4 respectively, 2% by weight of hydrophobic fine titanium oxide particles were externally added to obtain color toners of superior fluidity. Then, 6 parts by weight of each color toner and 94 parts by weight of a resin-coated magnetic ferrite carrier with an average particle diameter of 50 μm were blended to prepare a two-component developer for magnetic brush development.

The two-component developer was loaded into a digital full-color copying machine CLC-500, manufactured by Canon Inc. in which the toner image is transferred directly from the photosensitive drum to a transfer medium without any intermediate transfer medium. Using this machine unfixed toner images were formed on both plain paper and OHP films in both monochromatic mode and full-color mode. Using an external heat roller fixing assembly comprised of an upper roller of 60 mm diameter having a fluorine resin surface layer and a lower roller of 60 mm diameter having a fluorine resin surface layer, the unfixed toner images on the plain paper were fixed in a temperature range of from 80° to 230° C. to evaluate the fixation performance of the toner. The unfixed toner images on the OHP films were fixed at a temperature of 150° C. using the external heat roller fixing assembly.

Results of the evaluation are shown in Tables 10 to 12.

Comparative Experiment No. 1

The fixing performance of toners, anti-offset properties, transmittance (%) of fixed images on OHP films, haze of fixed images on OHP films, and color-mixing temperature range in full-color mode were evaluated in the same manner as in Experiment 1 except for using the toners of Comparative Examples 1 to 20.

Results of the evaluation are shown in Tables 10 to 12.

TABLE 10

| | | Fixing performance Fixing start point (°C.) | Anti-offset properties Low-temp. start point (°C.) | High-temp. end point (°C.) | Offset-free temp. range (°C.) |
|---|---|---|---|---|---|
| Ex. 1 | cyan toner: | 130 | 130 | 220 | 90 |
| Ex. 2 | yellow toner: | 130 | 130 | 220 | 90 |
| Ex. 3 | magenta toner: | 130 | 130 | 220 | 90 |
| Ex. 4 | black toner: | 130 | 130 | 220 | 90 |

TABLE 10-continued

| | | Fixing performance Fixing start point (°C.) | Anti-offset properties Low-temp. start point (°C.) | High-temp. end point (°C.) | Offset-free temp. range (°C.) |
|---|---|---|---|---|---|
| Cp. 1 | cyan toner: | 130 | 130 | 210 | 80 |
| Cp. 2 | yellow toner: | 130 | 130 | 210 | 80 |
| Cp. 3 | magenta toner: | 130 | 130 | 210 | 80 |
| Cp. 4 | black toner: | 130 | 130 | 210 | 80 |
| Cp. 5 | cyan toner: | 145 | 140 | 220 | 80 |
| Cp. 6 | yellow toner: | 145 | 140 | 220 | 80 |
| Cp. 7 | magenta toner: | 145 | 140 | 220 | 80 |
| Cp. 8 | black toner: | 145 | 140 | 220 | 80 |
| Cp. 9 | cyan toner: | 135 | 130 | 200 | 70 |
| Cp. 10 | yellow toner: | 135 | 130 | 200 | 70 |
| Cp. 11 | magenta toner: | 135 | 130 | 200 | 70 |
| Cp. 12 | black toner: | 135 | 130 | 200 | 70 |
| Cp. 13 | cyan toner: | 135 | 130 | 210 | 80 |
| Cp. 14 | yellow toner: | 135 | 130 | 210 | 80 |
| Cp. 15 | magenta toner: | 135 | 130 | 210 | 80 |
| Cp. 16 | black toner: | 135 | 130 | 210 | 80 |
| Cp. 17 | cyan toner: | 150 | 145 | 225 | 80 |
| Cp. 18 | yellow toner: | 155 | 145 | 225 | 80 |
| Cp. 19 | magenta toner: | 150 | 145 | 225 | 80 |
| Cp. 20 | black toner: | 150 | 145 | 225 | 80 |

Ex.: Example; Cp.: Comparative Example

TABLE 11

| | | On OHP film, transmittance of fixed image (%) | On OHP film, haze of fixed image |
|---|---|---|---|
| Ex. 1 | cyan toner: | 70 | 27 |
| Ex. 2 | yellow toner: | 66 | 31 |
| Ex. 3 | magenta toner: | 68 | 29 |
| Cp. 1 | cyan toner: | 67 | 30 |
| Cp. 2 | yellow toner: | 63 | 34 |
| Cp. 3 | magenta toner: | 65 | 32 |
| Cp. 5 | cyan toner: | 18 | 74 |
| Cp. 6 | yellow toner: | 14 | 78 |
| Cp. 7 | magenta toner: | 17 | 76 |
| Cp. 9 | cyan toner: | 32 | 68 |
| Cp. 10 | yellow toner: | 28 | 71 |
| Cp. 11 | magenta toner: | 31 | 70 |
| Cp. 13 | cyan toner: | 30 | 66 |
| Cp. 14 | yellow toner: | 26 | 70 |
| Cp. 15 | magenta toner: | 28 | 68 |
| Cp. 17 | cyan toner: | 17 | 73 |
| Cp. 18 | yellow toner: | 13 | 77 |
| Cp. 19 | magenta toner: | 15 | 75 |

Ex. : Example; Cp.: Comparative Example

TABLE 12

| | Color-mixing performance in full-color mode Low-temp. start point (°C.) | High-temp. end point (°C.) | Color-mixing temp. range (°C.) |
|---|---|---|---|
| C, Y, M, B toners of Ex. 1–4: | 130 | 220 | 140–200 |
| C, Y, M, B toners of Cp. 1–4: | 130 | 210 | 140–190 |
| C, Y, M, B toners of Cp. 5–8: | 140 | 220 | 150–200 |
| C, Y, M, B toners of | 130 | 200 | 140–175 |

TABLE 12-continued

| | Color-mixing performance in full-color mode Low-temp. start point (°C.) | High-temp. end point (°C.) | Color-mixing temp. range (°C.) |
|---|---|---|---|
| Cp. 9–12: C, Y, M, B toners of | 130 | 210 | 140–190 |
| Cp. 13–16: C, Y, M, B toners of | 145 | 225 | 155–205 |
| Cp. 17–20: | | | |

Examples 5 to 8

A cyan toner, a yellow toner, a magenta toner and a black toner were prepared in the same manner as in Examples 1 to 4, respectively, except that Wax Composition No. 1 was replaced with Wax Composition No. 2. Physical properties of the toners obtained are shown in Table 13.

TABLE 13

| Toner | Wt. average particle diameter (μm) | Co-efficient of variation* (%) | Wax** content (pbw) | Shell resin Mw | Shell resin Mn | Volume resistivity (Ω · cm) |
|---|---|---|---|---|---|---|
| Example: | | | | | | |
| 5 Cyan | 6.0 | 23 | 28 | 61,000 | 14,800 | $\geqq 10^{14}$ |
| 6 Yellow | 6.3 | 28 | 28 | 60,100 | 13,700 | $\geqq 10^{14}$ |
| 7 Magenta | 6.2 | 25 | 28 | 61,900 | 14,100 | $\geqq 10^{14}$ |
| 8 Black | 6.1 | 22 | 28 | 63,500 | 13,600 | $\geqq 10^{14}$ |

*in number distribution
**based on 100 parts by weight of binder resin

Examples 9 to 12

A cyan toner, a yellow toner, a magenta toner and a black toner were prepared in the same manner as in Examples 1 to 4, respectively, except that Wax Composition No. 1 was replaced with Wax Composition No. 3. Physical properties of the toners obtained are shown in Table 14.

TABLE 14

| Toner | Wt. average particle diameter (μm) | Co-efficient of variation* (%) | Wax** content (pbw) | Shell resin Mw | Shell resin Mn | Volume resistivity (Ω · cm) |
|---|---|---|---|---|---|---|
| Example: | | | | | | |
| 9 Cyan | 6.1 | 20 | 28 | 61,000 | 14,500 | $\geqq 10^{14}$ |
| 10 Yellow | 6.1 | 24 | 28 | 60,000 | 13,500 | $\geqq 10^{14}$ |
| 11 Magenta | 6.1 | 22 | 28 | 62,000 | 14,000 | $\geqq 10^{14}$ |
| 12 Black | 6.0 | 21 | 28 | 63,000 | 13,800 | $\geqq 10^{14}$ |

*in number distribution
**based on 100 parts by weight of binder resin

Examples 13 to 16

A cyan toner, a yellow toner, a magenta toner and a black toner were prepared in the same manner as in Examples 1 to 4, respectively, except that Wax Composition No. 1 was replaced with Wax Composition No. 4. Physical properties of the toners obtained are shown in Table 15.

TABLE 15

| Toner | Wt. average particle diameter (μm) | Co-efficient of variation (%)* | Wax content (pbw)** | Shell resin Mw | Shell resin Mn | Volume resistivity (Ω · cm) |
|---|---|---|---|---|---|---|
| Example: | | | | | | |
| 13 Cyan | 6.2 | 24 | 28 | 61,300 | 14,900 | ≧$10^{14}$ |
| 14 Yellow | 6.4 | 28 | 28 | 60,200 | 13,800 | ≧$10^{14}$ |
| 15 Magenta | 6.3 | 25 | 28 | 62,100 | 14,100 | ≧$10^{14}$ |
| 16 Black | 6.2 | 25 | 28 | 63,400 | 13,700 | ≧$10^{14}$ |

*in number distribution
**based on 100 parts by weight of binder resin

Examples 17 to 20

A cyan toner, a yellow toner, a magenta toner and a black toner were prepared in the same manner as in Examples 1 to 4, respectively, except that Wax Composition No. 1 was replaced with Wax Composition No. 5. Physical properties of the toners obtained are shown in Table 16.

TABLE 16

| Toner | Wt. average particle diameter (μm) | Co-efficient of variation (%)* | Wax content (pbw)** | Shell resin Mw | Shell resin Mn | Volume resistivity (Ω · cm) |
|---|---|---|---|---|---|---|
| Example: | | | | | | |
| 17 Cyan | 6.3 | 22 | 28 | 61,600 | 15,200 | ≧$10^{14}$ |
| 18 Yellow | 6.5 | 28 | 28 | 60,700 | 14,300 | ≧$10^{14}$ |
| 19 Magenta | 6.4 | 25 | 28 | 62,800 | 15,000 | ≧$10^{14}$ |
| 20 Black | 6.3 | 24 | 28 | 63,900 | 14,200 | ≧$10^{14}$ |

*in number distribution
**based on 100 parts by weight of binder resin

Experiment Nos. 2 to 5

Two-component developers for magnetic brush development were prepared in the same manner as in Experiment No. 1 except for using the toners of Examples 5 to 8 (Experiment No. 2), the toners of Examples 9 to 12 (Experiment No. 3), the toners of Examples 13 to 16 (Experiment No. 4) and the toners of Examples 17 to 20 (Experiment No. 5), and evaluation was made in the same manner as in Experiment No. 1. Results of the evaluation are shown in Tables 17 to 19.

TABLE 17

| | | Fixing performance Fixing start point (°C.) | Anti-offset properties Low-temp. start point (°C.) | High-temp. end point (°C.) | Offset-free temp. range (°C.) |
|---|---|---|---|---|---|
| Ex. 5 | cyan toner: | 130 | 125 | 220 | 95 |
| Ex. 6 | yellow toner: | 130 | 125 | 220 | 95 |
| Ex. 7 | magenta toner: | 130 | 125 | 220 | 95 |
| Ex. 8 | black toner: | 130 | 125 | 220 | 95 |
| Ex. 9 | cyan toner: | 130 | 130 | 220 | 90 |
| Ex. 10 | yellow toner: | 130 | 130 | 220 | 90 |
| Ex. 11 | magenta toner: | 130 | 130 | 220 | 90 |
| Ex. 12 | black toner: | 130 | 130 | 220 | 90 |
| Ex. 13 | cyan toner: | 130 | 130 | 220 | 90 |
| Ex. 14 | yellow toner: | 130 | 130 | 220 | 90 |
| Ex. 15 | magenta toner: | 130 | 130 | 220 | 90 |
| Ex. 16 | black toner: | 130 | 130 | 220 | 90 |
| Ex. 17 | cyan toner: | 130 | 130 | 225 | 95 |
| Ex. 18 | yellow toner: | 130 | 130 | 225 | 95 |
| Ex. 19 | magenta toner: | 130 | 130 | 225 | 95 |
| Ex. 20 | black toner: | 130 | 130 | 225 | 95 |

Ex.: Example

TABLE 18

| | | On OHP film, transmittance of fixed image (%) | On OHP film, haze of fixed image |
|---|---|---|---|
| Ex. 5 | cyan toner: | 69 | 28 |
| Ex. 6 | yellow toner: | 65 | 31 |
| Ex. 7 | magenta toner: | 68 | 28 |
| Ex. 9 | cyan toner: | 72 | 27 |
| Ex. 10 | yellow toner: | 68 | 31 |
| Ex. 11 | magenta toner: | 70 | 28 |
| Ex. 13 | cyan toner: | 67 | 29 |
| Ex. 14 | yellow toner: | 63 | 34 |
| Ex. 15 | magenta toner: | 66 | 32 |
| Ex. 17 | cyan toner: | 70 | 26 |
| Ex. 18 | yellow toner: | 66 | 30 |
| Ex. 19 | magenta toner: | 68 | 28 |

Ex.: Example

TABLE 19

| | Color-mixing performance in full-color mode: Low-temp. start point (°C.) | High-temp. end point (°C.) | Color-mixing temp. range (°C.) |
|---|---|---|---|
| Experiment No. 2 C,Y,M,B toners of Ex. 5–8: | 125 | 220 | 140–200 |
| Experiment No. 3 C,Y,M,B toners of Ex. 9–12: | 130 | 220 | 140–200 |
| Experiment No. 4 C,Y,M,B toners of Ex. 13–16: | 130 | 220 | 140–200 |
| Experiment No. 5 C,Y,M,B toners of Ex. 17–20: | 130 | 225 | 140–205 |

Example 21

| | |
|---|---|
| Styrene-butyl acrylate-divinylbenzene copolymer (copolymerization weight ratio: 80:15:5; weight average molecular weight: about 50,000) | 100 parts* |
| Magnetic iron oxide treated with silane coupling agent (average particle diameter: 0.25 μm; under 10K oersted; saturation magnetization: 65 emu/g; residual magnetization: 10 emu/g; coercive force: 120 oersted) | 80 parts* |
| Di-t-butylsalicylic acid metal compound | 2 parts* |
| Wax composition No. 1 | 10 parts* |

*by weight

The above materials were premixed, and thereafter melt-kneaded using a twin-screw extruder set at 130° C. The kneaded product was cooled, and then crushed. The crushed product was finely pulverized by means of a grinding mill using a jet stream. Subsequently, the pulverized powder obtained was classified using an air classifier to obtain a negatively chargeable insulating magnetic toner with a weight average particle diameter of 7.5 μm and a variation coefficient in number distribution, of 29%. Then 100 parts by weight of this magnetic toner and 0.7 part of hydrophobic fine silica powder were mixed (external addition) to obtain a magnetic toner having hydrophobic fine silica powder on the toner particle surfaces.

Using this magnetic toner and an electrophotographic copying machine NP-8582 (Canon Inc.), unfixed toner images were formed on plain paper to evaluate fixing performance and anti-offset properties.

Further using this magnetic toner and using the electrophotographic copying machine NP-8582, fixed images were obtained to measure the image density at solid black areas using a Macbeth densitometer. Results obtained are shown in Table 20.

Comparative Example 21

A magnetic toner was prepared in the same manner as in Example 21 except that Wax Composition No. 1 was replaced with 10 parts by weight of Ester Wax No. 1 alone, and evaluation was made in the same manner as in Example 21. Results obtained are shown in Table 20.

Comparative Example 22

A magnetic toner was prepared in the same manner as in Example 21 except that Wax Composition No. 1 was replaced with 10 parts by weight of the polyethylene wax shown in Table 3. Evaluation was also made in the same manner as in Example 21. Results obtained are shown in Table 20.

Comparative Example 23

A magnetic toner was prepared in the same manner as in Example 21 except that Wax Composition No. 1 was replaced with 10 parts by weight of polypropylene wax (Mw: 6,000), and evaluation was made in the same manner as in Example 21. Results obtained are shown in Table 20.

Comparative Example 24

A magnetic toner was prepared in the same manner as in Example 21 except that Wax Composition No. 1 was replaced with 10 parts by weight of paraffin wax (Mw: 550), and evaluation was made in the same manner as in Example 21. Results obtained are shown in Table 20.

TABLE 20

| | Fixing | Anti-offset properties | | | |
|---|---|---|---|---|---|
| | performance Fixing start point (°C.) | Low-temp. start point (°C.) | High-temp. end point (°C.) | Offset-free temp. range (°C.) | Image density |
| Example: | | | | | |
| 21 | 150 | 140 | 215 | 75 | 1.53 |
| Comparative Example: | | | | | |
| 21 | 150 | 140 | 205 | 65 | 1.49 |
| 22 | 160 | 150 | 215 | 65 | 1.45 |
| 23 | 165 | 155 | 215 | 60 | 1.48 |
| 24 | 150 | 145 | 210 | 65 | 1.44 |

What is claimed is:

1. A toner for developing electrostatic images, comprising a binder resin, a colorant and a wax composition;

said wax composition having, in molecular weight distribution as measured by GPC, a maximal value in the region of molecular weight of from 350 to 850 and a maximal value in the region of molecular weight of from 900 to 4,000; and said wax composition having ester wax with a weight average molecular weight (Mw) of from 350 to 4,000 and a number average molecular weight of from 200 to 4,000.

2. The toner according to claim 1, wherein said wax composition has a maximal value in the region of molecular weight of from 400 to 800 and a maximal value in the region of molecular weight of from 950 to 3,000.

3. The toner according to claim 1, wherein said wax composition contains a low-molecular weight wax with a weight average molecular weight of from 350 to 850 and a high-molecular weight wax with a weight average molecular weight of from 900 to 4,000.

4. The toner according to claim 3, wherein said wax composition contains a low-molecular weight wax with a weight average molecular weight of from 400 to 800 and a high-molecular weight wax with a weight average molecular weight of from 950 to 3,000.

5. The toner according to claim 3 or 4, wherein said low-molecular weight wax is an ester wax.

6. The toner according to claim 3 or 4, wherein said high-molecular weight wax is a hydrocarbon wax which may have a functional group.

7. The toner according to claim 6, wherein said hydrocarbon wax has a number average molecular weight (Mn) of from 550 to 1,200.

8. The toner according to claim 7, wherein said hydrocarbon wax has a number average molecular weight (Mn) of from 600 to 1,000.

9. The toner according to claim 1, wherein said ester wax has a melting point of from 30° C. to 120° C.

10. The toner according to claim 9, wherein said ester wax has a melting point of from 50° C. to 100° C.

11. The toner according to claim 1, wherein said ester wax has a solubility parameter value of from 7.5 to 10.5.

12. The toner according to claim 1, wherein said ester wax has a melt viscosity of from 1 cps to 300 cps at 130° C.

13. The toner according to claim 12, wherein said ester wax has a melt viscosity of from 3 cps to 50 cps at 130° C.

14. The toner according to claim 1, wherein said ester wax has a Vickers hardness of from 0.3 to 5.0.

15. The toner according to claim 14, wherein said ester wax has a Vickers hardness of from 0.5 to 3.0.

16. The toner according to claim 1, wherein said wax composition contains the ester wax and a hydrocarbon wax which may have a functional group, and the ester wax and the hydrocarbon wax which may have a functional group are mixed in a weight ratio of from 5:95 to 95:5.

17. The toner according to claim 16, wherein said ester wax and said hydrocarbon wax which may have a functional group are mixed in a weight ratio of from 10:90 to 90:10.

18. The toner according to claim 16 or 17, wherein said hydrocarbon wax which may have a functional group is a wax selected from the group consisting of a long straight-chain hydrocarbon wax, a graft wax and a long-chain alkyl alcohol wax.

19. The toner according to claim 1, wherein said wax composition is contained in an amount of from 1 part by weight to 40 parts by weight based on 100 parts by weight of the binder resin.

20. The toner according to claim 19, wherein said wax composition is contained in an amount of from 2 parts by weight to 30 parts by weight based on 100 parts by weight of the binder resin.

21. The toner according to claim 1, wherein said wax composition is encapsulated with the binder resin.

22. The toner according to claim 1, wherein said toner comprises toner particles directly produced from a monomer composition containing at least a polymerizable monomer, the colorant, the wax composition and a polymerization initiator, and said wax composition is encapsulated with the binder resin.

23. The toner according to claim 1, wherein said binder resin has a number average molecular weight of from 3,000 to 1,000,000.

24. The toner according to claim 1, wherein said toner is a non-magnetic cyan color toner.

25. The toner according to claim 1, wherein said toner is a non-magnetic yellow color toner.

26. The toner according to claim 1, wherein said toner is a non-magnetic magenta color toner.

27. The toner according to claim 1, wherein said toner is a non-magnetic black toner.

28. The toner according to claim 1, wherein said toner is a magnetic toner.

* * * * *

UNITED STATES PATENT AND TRADEMARK OFFICE

CERTIFICATE OF CORRECTION

PATENT NO. : 5,741,617

DATED : April 21, 1998

INVENTOR(S) : KOJI INABA ET AL.

It is certified that error appears in the above-identified patent and that said Letters Patent is hereby corrected as shown below:

Title page:

AT [56] REFERENCES CITED

OTHER PUBLICATIONS

After "Diamond, Arthur S.": "Marecl-Dekker," should read --Marcel-Dekker,--.

COLUMN 1

Line 6, "invention" should read --Invention--; and
Line 8, "cycels" should read --excels--.

COLUMN 2

Line 66, "of haze" should read --or haze--.

COLUMN 3

Line 18, "which" should read --those which--; and
Line 21, "low tem-" should read --low-tem- --.

COLUMN 5

Line 47, "Parkin" should read --Perkin--.

COLUMN 6

Line 10, "130° C." should read --130° C. An--.

UNITED STATES PATENT AND TRADEMARK OFFICE

CERTIFICATE OF CORRECTION

PATENT NO. : 5,741,617

DATED : April 21, 1998

INVENTOR(S) : KOJI INABA ET AL.

It is certified that error appears in the above-identified patent and that said Letters Patent is hereby corrected as shown below:

COLUMN 12

Line 9, "by" should read --by washing--;
Line 10, "resan" should read --resin--;
Line 11, "chloroform) Thereafter" should read --chloroform). Thereafter,-- and "an" should read --tetrahydrofuran--;
Line 43, "resin" should read --resins--;
Line 45, "resins" should read --resin--; and
Line 46, "employed" should read --employed,--.

COLUMN 13

Line 39, "material" should read --materials--; and
Line 42, "(or)" should read --(σr)--.

COLUMN 14

Line 13, "followings" should read --the following--; and
Line 29, "black." should read --black may be used.--.

COLUMN 16

Line 21, "amide" should read --amide.--.

COLUMN 17

Line 12, "eu-acrylic" should read --acrylic--; and
Line 18, "agent" should read --agents--.

UNITED STATES PATENT AND TRADEMARK OFFICE

CERTIFICATE OF CORRECTION

PATENT NO. : 5,741,617

DATED : April 21, 1998

INVENTOR(S) : KOJI INABA ET AL.

It is certified that error appears in the above-identified patent and that said Letters Patent is hereby corrected as shown below:

COLUMN 18

Line 14, "water soluble" should read --water-soluble--; and
Line 29, "cross sectional" should read --cross-sectional--.

COLUMN 19

Line 23, "it is" should be deleted.

COLUMN 20

Line 60, "(" should be deleted; and
Line 61, "yellow," should read --(yellow,--.

COLUMN 22

Line 57, "Examples." should read --Examples.
¶ Preparation of Wax Composition No. 1--.

COLUMN 25

Line 5, "compound" should read --compound)--; and
Lines 8-12, Lines 8 to 12 should be deleted.

COLUMN 26

Line 45, "$>10^{14}$" should read --$\geq 10^{14}$--.
$>10^{14}$ $\geq 10^{14}$
$>10^{14}$ $\geq 10^{14}$

UNITED STATES PATENT AND TRADEMARK OFFICE

CERTIFICATE OF CORRECTION

PATENT NO. : 5,741,617

DATED : April 21, 1998

INVENTOR(S) : KOJI INABA ET AL.

It is certified that error appears in the above-identified patent and that said Letters Patent is hereby corrected as shown below:

COLUMN 28

Line 20, "4" should read --4,--.

Signed and Sealed this

Tenth Day of November 1998

*Attest:*

*Attesting Officer*

BRUCE LEHMAN

*Commissioner of Patents and Trademarks*

UNITED STATES PATENT AND TRADEMARK OFFICE

CERTIFICATE OF CORRECTION

PATENT NO. : 5,741,617
DATED : April 21, 1998
INVENTOR(S) : Koji Inaba et al.

It is certified that error appears in the above-identified patent and that said Letters Patent is hereby corrected as shown below:

Item [56] References Cited,

OTHER PUBLICATIONS
After "Diamond, Arthur S.": "Marecl-Dekker,"
should read -- Marcel-Dekker, --.

Column 1,
Line 6, "invention" should read -- Invention --; and
Line 8, "cycels" should read -- excels --.

Column 2,
Line 66, "of haze" should read -- or haze --.

Column 3,
Line 18, "which" should read -- those which --; and
Line 21, "low tem-" should read -- low-tem- --.

Column 5,
Line 47, "Parkin" should read -- Perkin --.

Column 6,
Line 10, "130° C." should read -- 130° C. An --.

Column 12
Line 9, "by" should read -- by washing --;
Line 10, "resan" should read -- resin --;
Line 11, "chloroform) Thereafter" should read -- chloroform). Thereafter, -- and
"an" should read -- tetrahydrofuran --;
Line 43, "resin" should read -- resins --;
Line 45, "resins" should read -- resin --; and
Line 46, "employed" should read -- employed, --.

Column 13
Line 39, "material" should read -- materials --; and
Line 42, "(or)" should read -- ($\sigma\tau$) --.

UNITED STATES PATENT AND TRADEMARK OFFICE

CERTIFICATE OF CORRECTION

PATENT NO. : 5,741,617
DATED : April 21, 1998
INVENTOR(S) : Koji Inaba et al.

It is certified that error appears in the above-identified patent and that said Letters Patent is hereby corrected as shown below:

Column 14,
Line 13, "followings" should read --the following --; and
Line 29, "black." should read -- black may be used. --.

Column 16,
Line 21, "amide" should read -- amide. --.

Column 17,
Line 12, "eu-acrylic" should read -- acrylic --; and
Line 18, "agent" should read -- agents --.

Column 18,
Line 14, "water soluble" should read -- water-soluble --; and
Line 29, "cross sectional" should read -- cross-sectional --.

Column 19,
Line 23, "it is" should be deleted.

Column 20,
Line 60, "(" should be deleted; and
Line 61, "yellow," should read -- (yellow, --.

Column 22,
Line 57, "Examples." should read -- Examples.
¶ Preparation of Wax Composition No. 1 --.

Column 25,
Line 5, "compound" should read -- compound) --; and
Lines 8-12, Lines 8 to 12 should be deleted.

Column 26,
Line 45 , "$>10^{14}$" should read --$\geq 10^{14}$--.
$>10^{14}$ $\geq 10^{14}$
$>10^{14}$ $\geq 10^{14}$ Column 28,
Line 20, "4" should read -- 4, --.

UNITED STATES PATENT AND TRADEMARK OFFICE

CERTIFICATE OF CORRECTION

PATENT NO. : 5,741,617
DATED : April 21, 1998
INVENTOR(S) : Koji Inaba et al.

It is certified that error appears in the above-identified patent and that said Letters Patent is hereby corrected as shown below:

Column 7,
Lines 30-40, "Ester Compound No. 1: (molecular weight: 852)

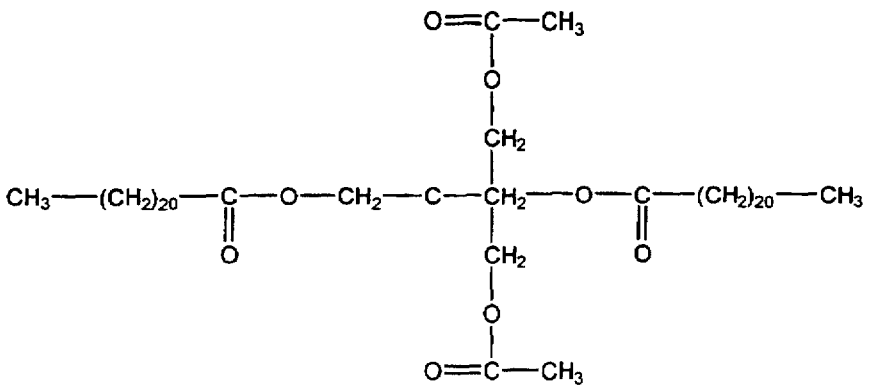

"

should read

-- Ester Compound No. 1: (molecular weight: 852)

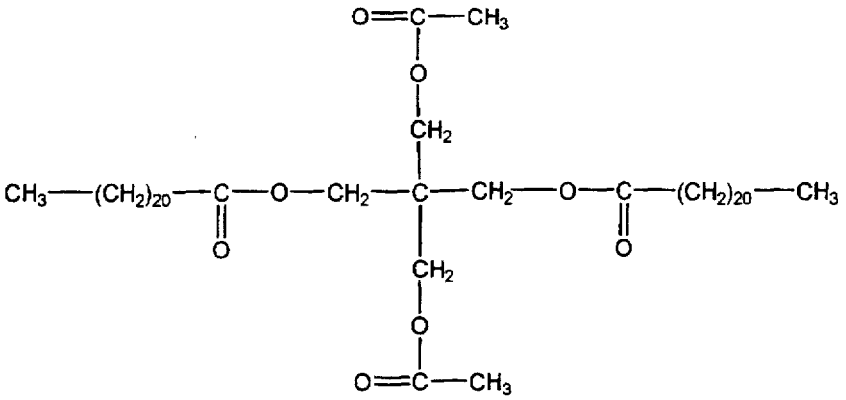

--.

CERTIFICATE OF CORRECTION

PATENT NO. : 5,741,617
DATED : April 21, 1998
INVENTOR(S) : Koji Inaba et al.

It is certified that error appears in the above-identified patent and that said Letters Patent is hereby corrected as shown below:

Column 7,
Lines 40-50, "Ester Compound No. 2: (molecular weight: 626)

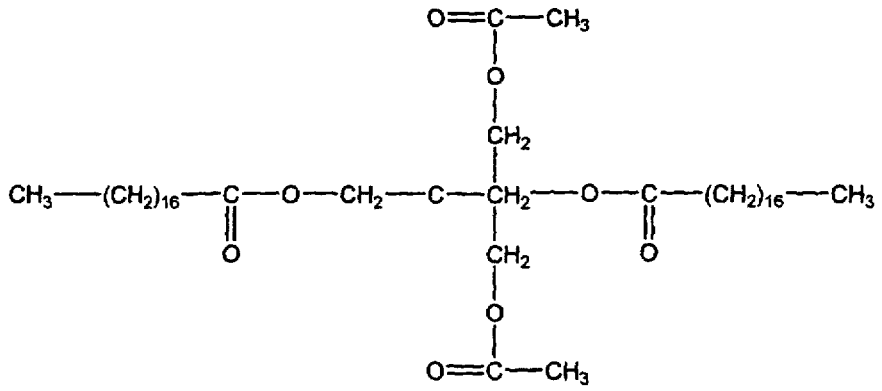

"

should read

-- Ester Compound No. 2: (molecular weight: 626)

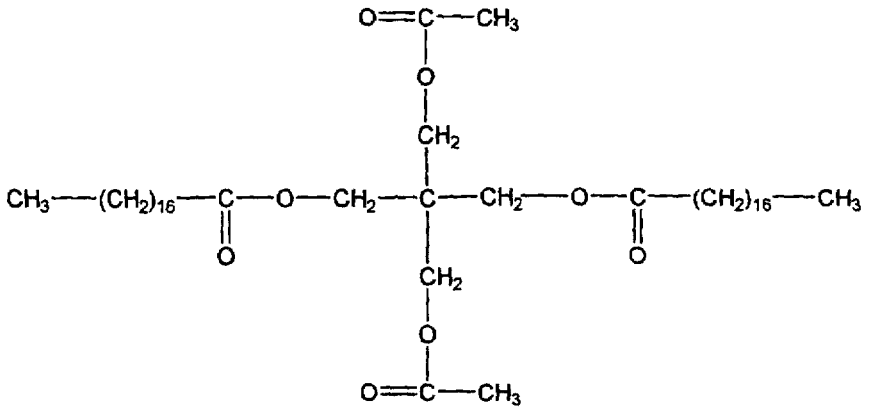

-- .

UNITED STATES PATENT AND TRADEMARK OFFICE

CERTIFICATE OF CORRECTION

PATENT NO. : 5,741,617
DATED : April 21, 1998
INVENTOR(S) : Koji Inaba et al.

It is certified that error appears in the above-identified patent and that said Letters Patent is hereby corrected as shown below:

Column 7,
Lines 52-66, "Ester Compound No. 3: (molecular weight: 972)

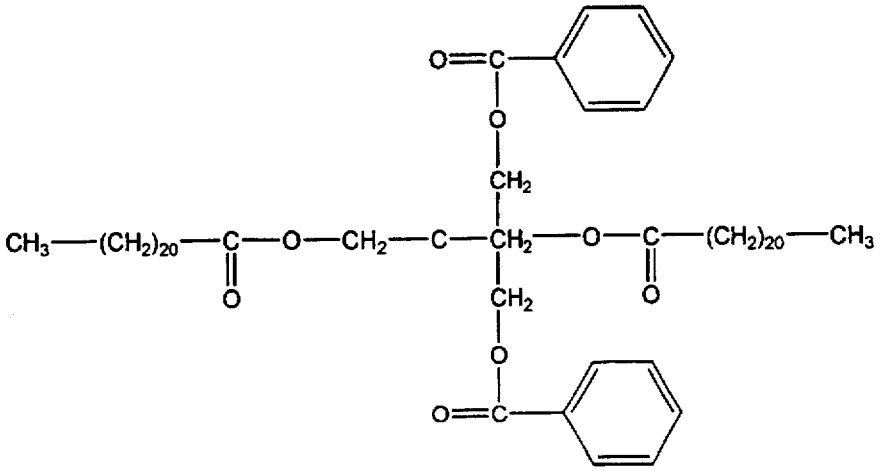

"

should read

-- Ester Compound No. 3: (molecular weight: 972)

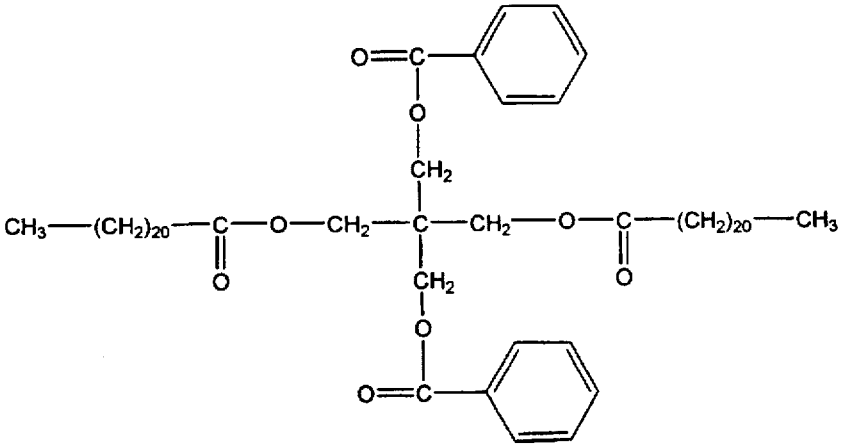

-- .

UNITED STATES PATENT AND TRADEMARK OFFICE

CERTIFICATE OF CORRECTION

PATENT NO. : 5,741,617
DATED : April 21, 1998
INVENTOR(S) : Koji Inaba et al.

It is certified that error appears in the above-identified patent and that said Letters Patent is hereby corrected as shown below:

Column 8,
Lines 1-12, "Ester Compound No. 4: (molecular weight: 1,424)

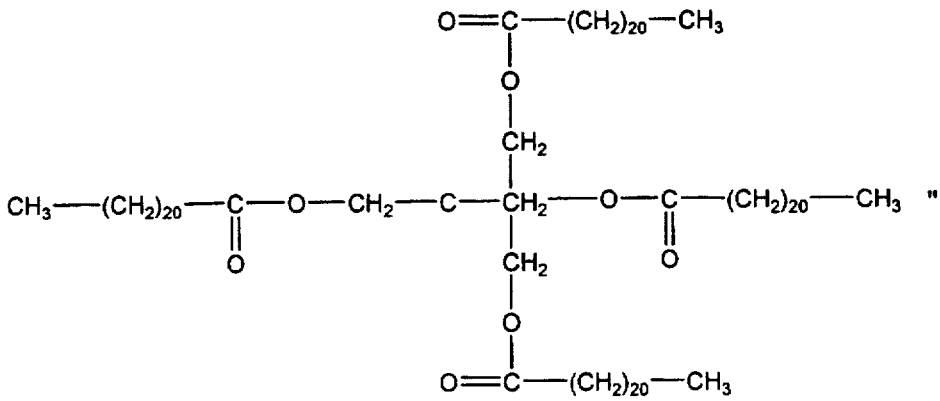

should read

-- Ester Compound No. 4: (molecular weight: 1,424)

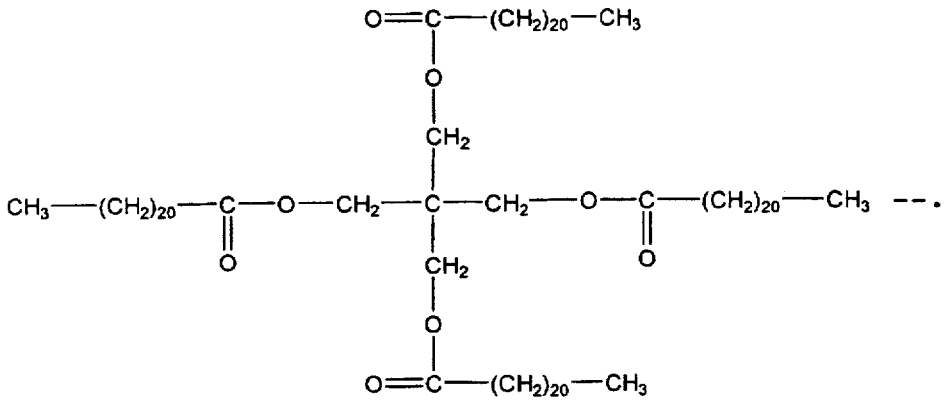

UNITED STATES PATENT AND TRADEMARK OFFICE

CERTIFICATE OF CORRECTION

PATENT NO. : 5,741,617
DATED : April 21, 1998
INVENTOR(S) : Koji Inaba et al.

It is certified that error appears in the above-identified patent and that said Letters Patent is hereby corrected as shown below:

Column 8,
Lines 14-24, "Ester Compound No. 5: (molecular weight: 1.444)

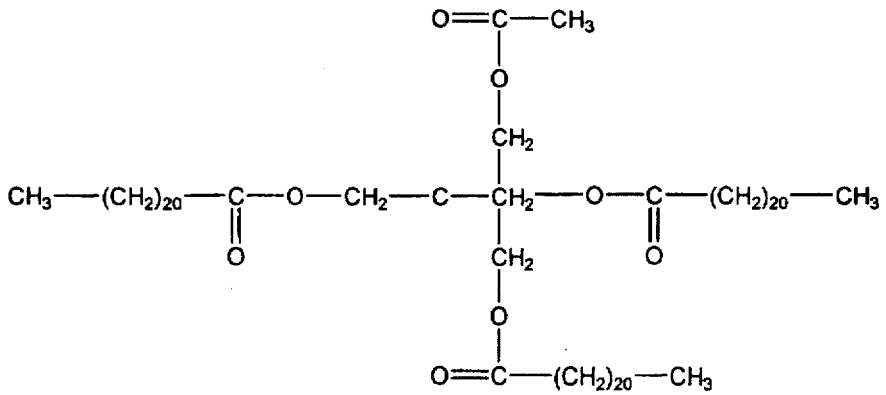

"

should read

-- Ester Compound No. 5: (molecular weight: 1,444)

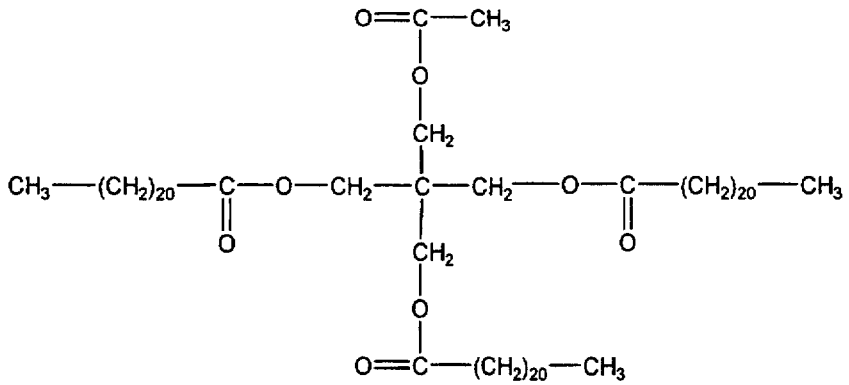

--.

UNITED STATES PATENT AND TRADEMARK OFFICE

CERTIFICATE OF CORRECTION

PATENT NO. : 5,741,617
DATED : April 21, 1998
INVENTOR(S) : Koji Inaba et al.

It is certified that error appears in the above-identified patent and that said Letters Patent is hereby corrected as shown below:

Column 8,
Lines 25-34, "Ester Compound No. 6: (molecular weight: 1,102)

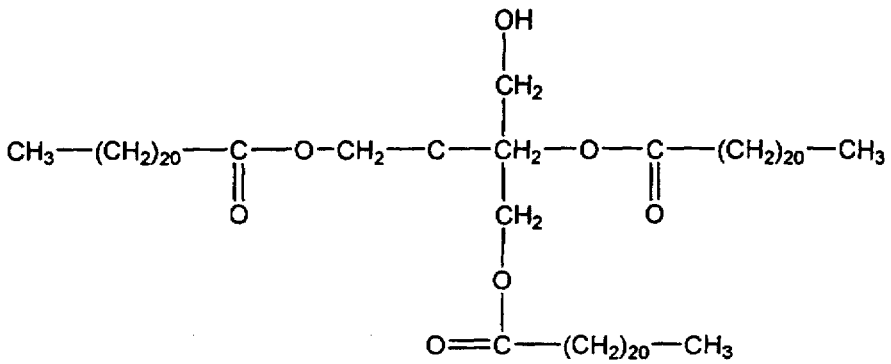

"

should read

-- Ester Compound No. 6: (molecular weight: 1,102)

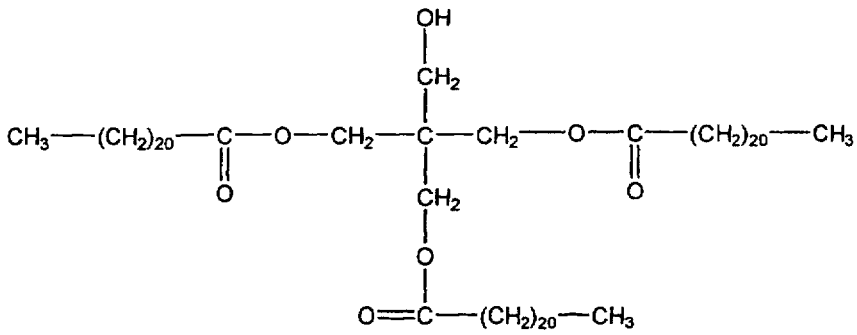

--.

UNITED STATES PATENT AND TRADEMARK OFFICE

CERTIFICATE OF CORRECTION

PATENT NO. : 5,741,617
DATED : April 21, 1998
INVENTOR(S) : Koji Inaba et al.

It is certified that error appears in the above-identified patent and that said Letters Patent is hereby corrected as shown below:

Column 8,
Lines 35-42, "Ester Compound No. 7: (molecular weight: 1,100)

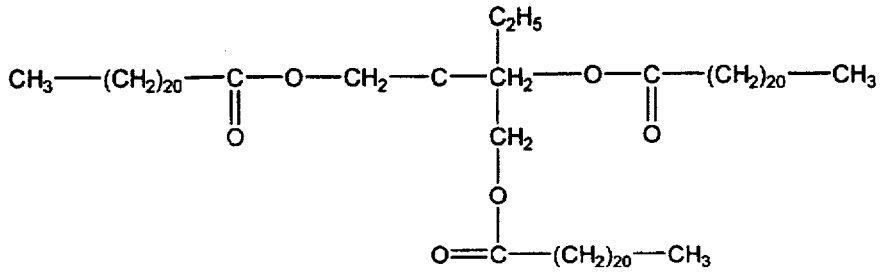

"

should read

-- Ester Compound No. 7: (molecular weight: 1,100)

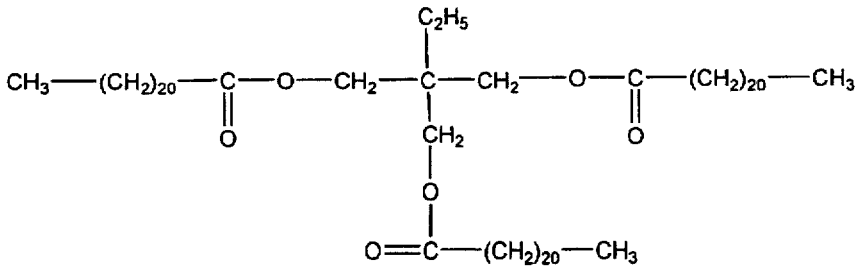

--.

UNITED STATES PATENT AND TRADEMARK OFFICE

CERTIFICATE OF CORRECTION

PATENT NO. : 5,741,617
DATED : April 21, 1998
INVENTOR(S) : Koji Inaba et al.

It is certified that error appears in the above-identified patent and that said Letters Patent is hereby corrected as shown below:

Column 8,
Lines 44-48, "Ester Compound No. 8: (molecular weight: 748)

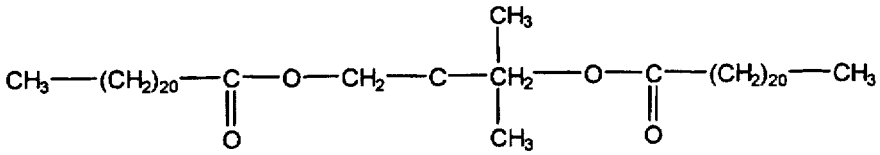

"

should read

-- Ester Compound No. 8: (molecular weight: 748)

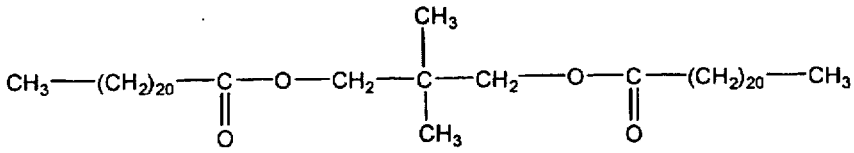

--.

UNITED STATES PATENT AND TRADEMARK OFFICE

CERTIFICATE OF CORRECTION

PATENT NO. : 5,741,617
DATED : April 21, 1998
INVENTOR(S) : Koji Inaba et al.

It is certified that error appears in the above-identified patent and that said Letters Patent is hereby corrected as shown below:

Column 8,
Lines 55-65, "Ester Compound No. 10: (molecular weight: 584)

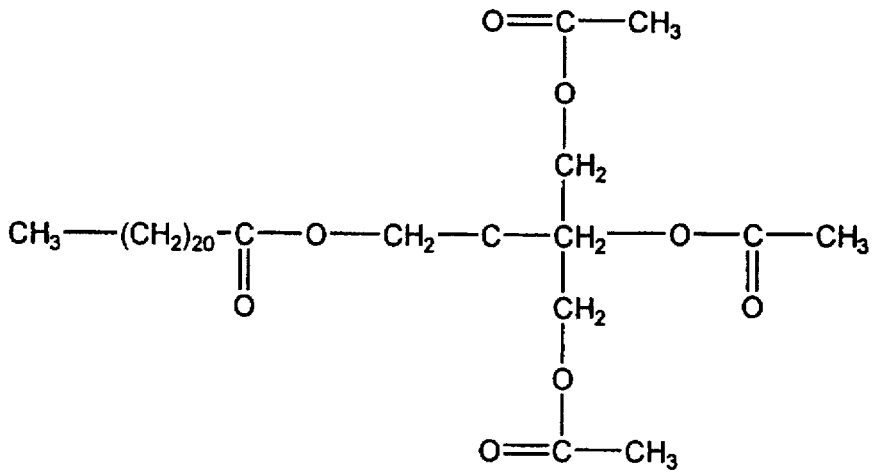

"

should read

-- Ester Compound No. 10: (molecular weight: 584)

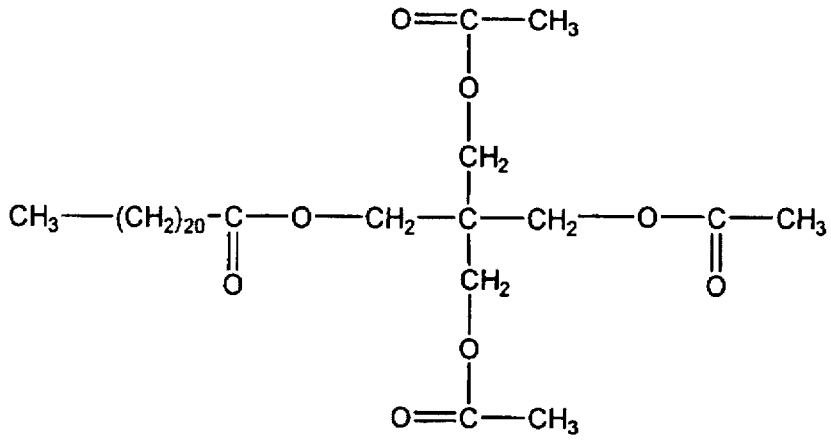

--.

UNITED STATES PATENT AND TRADEMARK OFFICE

CERTIFICATE OF CORRECTION

PATENT NO. : 5,741,617
DATED : April 21, 1998
INVENTOR(S) : Koji Inaba et al.

It is certified that error appears in the above-identified patent and that said Letters Patent is hereby corrected as shown below:

Column 9,
Lines 2-13, "Ester Compound No. 11: (molecular weight: 1,211)

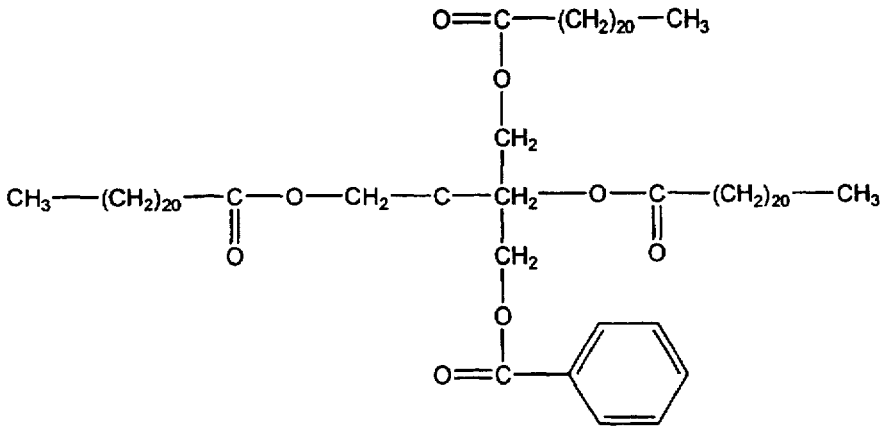

"

should read

-- Ester Compound No. 11: (molecular weight: 1,211)

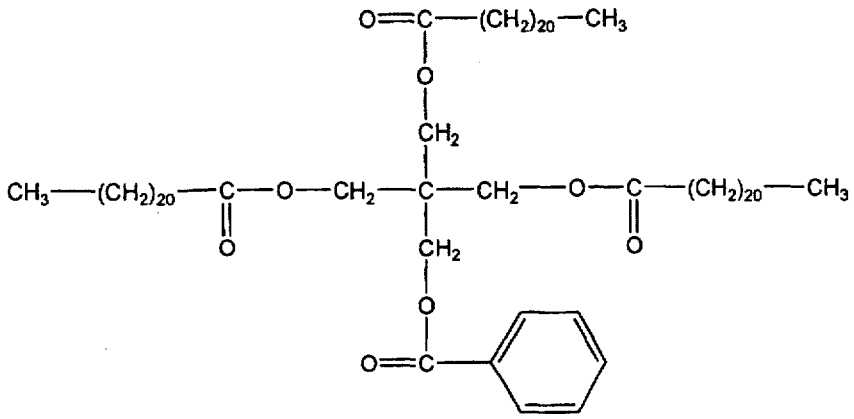

--.

UNITED STATES PATENT AND TRADEMARK OFFICE

CERTIFICATE OF CORRECTION

PATENT NO. : 5,741,617
DATED : April 21, 1998
INVENTOR(S) : Koji Inaba et al.

It is certified that error appears in the above-identified patent and that said Letters Patent is hereby corrected as shown below:

Column 9,
Lines 15-27, "Ester Compound No. 12: (molecular weight: 770)

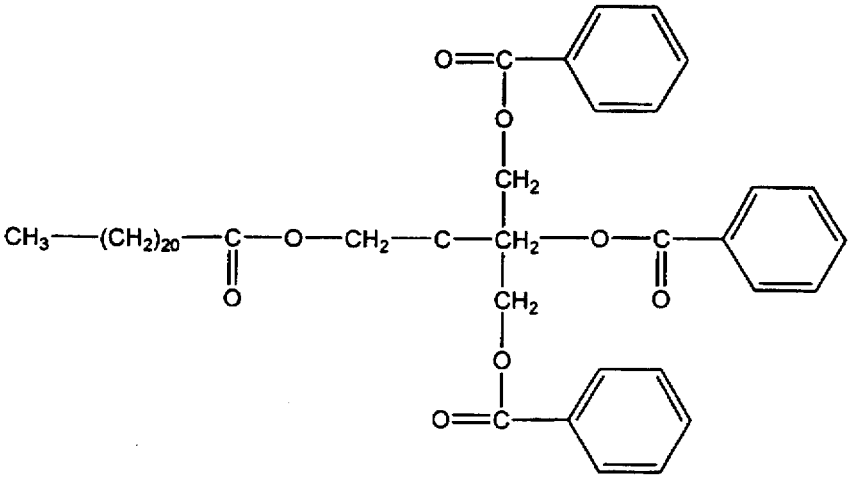

"

should read

UNITED STATES PATENT AND TRADEMARK OFFICE

CERTIFICATE OF CORRECTION

PATENT NO. : 5,741,617
DATED : April 21, 1998
INVENTOR(S) : Koji Inaba et al.

It is certified that error appears in the above-identified patent and that said Letters Patent is hereby corrected as shown below:

-- Ester Compound No. 12: (molecular weight: 770)

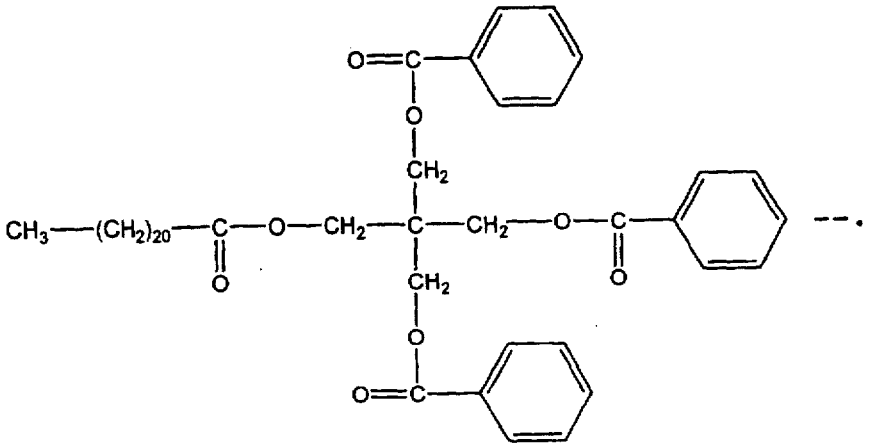

--.

Signed and Sealed this

Twenty-fifth Day of December, 2001

*Attest:*

*Attesting Officer*

JAMES E. ROGAN
*Director of the United States Patent and Trademark Office*